US010244298B1

(12) United States Patent
Prelogar et al.

(10) Patent No.: US 10,244,298 B1
(45) Date of Patent: Mar. 26, 2019

(54) WEARABLE WIRELESS AUDIO DEVICE

(71) Applicants: Barrett Prelogar, Lake Ozark, MO (US); Patsy Prelogar, Lake Ozark, MO (US)

(72) Inventors: Barrett Prelogar, Lake Ozark, MO (US); Patsy Prelogar, Lake Ozark, MO (US)

(73) Assignee: Piearcings, LLC, Kansas City, MO (US)

( * ) Notice: Subject to any disclaimer, the term of this patent is extended or adjusted under 35 U.S.C. 154(b) by 0 days.

(21) Appl. No.: 15/830,546

(22) Filed: Dec. 4, 2017

Related U.S. Application Data

(63) Continuation-in-part of application No. 15/189,251, filed on Jun. 22, 2016, now Pat. No. 9,888,309, which is a continuation-in-part of application No. 14/798,073, filed on Jul. 13, 2015, now Pat. No. 9,942,645, which is a continuation of application No. 13/835,975, filed on Mar. 15, 2013, now Pat. No. 9,084,054.

(60) Provisional application No. 62/429,366, filed on Dec. 2, 2016, provisional application No. 61/640,303, filed on Apr. 30, 2012.

(51) Int. Cl.
*H04R 1/02* (2006.01)

(52) U.S. Cl.
CPC ..... *H04R 1/02* (2013.01)

(58) Field of Classification Search
CPC .... H04R 1/02; H04R 1/1016; H04R 2460/13; H04R 2420/07; H04R 1/1066; H04R 1/1033; H04R 1/1041; H04R 1/028; H04R 2201/023; A44C 7/00
USPC ..... 381/334, 380
See application file for complete search history.

(56) References Cited

U.S. PATENT DOCUMENTS

2010/0041447 A1* 2/2010 Graylin ..... H04M 1/05 455/575.2

* cited by examiner

*Primary Examiner* — Paul S Kim
(74) *Attorney, Agent, or Firm* — Erickson Kernell IP, LLC

(57) ABSTRACT

A wireless audio device including a cover that is wearable as a personal article or as part of a personal article. The audio device is disposable in the pinna of a user's ear for receiving an audible output therefrom and is often used in pairs, e.g. one in each ear. The audio device includes a wireless communications unit and a sound-production unit disposed in a housing. The cover is adapted to be worn on the user's body as an accessory or as a part of a wearable personal article, such as jewelry, a watch, a belt, a belt buckle, clothing, a hat, or the like. The cover at least partially encloses a portion of the housing and may provide charging of the audio device.

20 Claims, 16 Drawing Sheets

WEARABLE WIRELESS AUDIO DEVICE

CROSS-REFERENCE TO RELATED APPLICATIONS

This application claims the benefit of U.S. Provisional Patent Application No. 62/429,366 filed Dec. 2, 2016 and of U.S. patent application Ser. No. 15/189,251 filed Jun. 22, 2016 which is a continuation-in-part of U.S. patent application Ser. No. 14/798,073, filed Jul. 13, 2015, which is a continuation of U.S. patent application Ser. No. 13/835,975 filed Mar. 15, 2013 and issued on Jul. 14, 2015 as U.S. Pat. No. 9,084,054, and to U.S. Provisional Patent Application No. 61/640,303, filed Apr. 30, 2012, the disclosures of each of which are hereby incorporated herein in their entirety by reference.

BACKGROUND

Wireless technologies and miniaturization of computer hardware have exploded in recent years to enable a variety of new applications. One such application is the audio device or headphone. Traditional audio devices employed a pair of speakers tethered by respective wires to a single headphone jack, which could be plugged into an audio player or device. Subsequent audio devices eliminated the wires tethering the speakers to the audio player in lieu of wireless communications. Early wireless audio devices employed a wired connection between speaker units, but more recent technologies enable completely wireless and physically separate speaker units which can be installed in or on the ear.

Manufacturers of such wireless speaker units provide a case in which the wireless speaker units can be placed for charging and storage when not in use. The cases can be somewhat large and thus may not lend well to being placed in small pockets or the like. The cases thus must typically be carried by the user in hand or in a handbag, backpack, or similar bag or disposed in a safe location. This may be inconvenient for the user and can increase risks of misplacing, losing, or having the case and wireless speaker units stolen.

SUMMARY

Exemplary embodiments are defined by the claims below, not this summary. A high-level overview of various aspects thereof is provided here to introduce a selection of concepts that are further described in the Detailed-Description section below. This summary is not intended to identify key features or essential features of the claimed subject matter, nor is it intended to be used in isolation to determine the scope of the claimed subject matter. In brief, this disclosure describes, among other things, a wireless audio device that has an in-use state in which the device is disposable at least partially within the contours of the pinna of a user's ear to provide an audio output to the user and a non-use state in which the device is worn on the user's person as, or in association with a personal article worn by the user on his or her body.

The audio device includes a wireless communications unit configured to enable wireless communication with one or both of a second similarly configured audio device and a master device such as a smartphone, tablet computer, music player, or other preferably portable computing device configured for wireless communications. A sound-production unit is also provided to produce an audio output based on communications received from the master device. The audio device also includes a cover which may be integral with or separable from the sound-production unit and is configured to at least partially enclose the audio device in the non-use state.

In the in-use state the audio device is at least partially disposed within the contours of the pinna of the user's ear, e.g. placed in the user's ear in or near the ear canal to direct the audio output into the ear canal. In the non-use state the audio device is stored in the cover which is incorporated into, or forms a part of a wearable personal article. The device is thus stored and worn on the user's person when not in use and is easily accessible when use is again desired. The cover may also provide charging and/or data communications between the master device and the audio device.

In another embodiment, a wireless audio device is described that is disposable substantially within the ear of a user. Covers for the audio device as well as articles with covers for the audio device integrated therein are also described. The device includes a body with a wireless communications unit and battery among other components disposed therein and a sound-production unit, such as a speaker or transducer disposed at one end of the body. The body may include a touch interface on a surface thereof or a radar-based input sensor may be provided to enable gesture-based inputs. In one embodiment, a generally torus-shaped ear tip is provided on a frame surrounding the sound-production unit and, when the audio device is inserted at least partially into the ear canal of a user, contacts the surface of the ear canal to frictionally maintain the audio device in the ear canal as well as to provide a seal between the audio device and the wall of the ear canal.

The body of the audio device includes a diametrical dimension that is generally equal to or smaller than that of the ear tip. The body is thus at least partially insertable into the ear canal. A gripping feature, such as an annular groove sized for engagement by a fingernail of a user, may be provided on the body to aid removal of the audio device from the ear canal of the user.

When listening is not desired, the audio device can be disposed in a cover for storage. The cover can be associated with or integrated into wearable articles such as jewelry, watches, eyeglasses, headbands, clothing, and the like. The cover may be configured to charge the battery in the audio device while the audio device is inserted in the cover.

DESCRIPTION OF THE DRAWINGS

Illustrative embodiments are described in detail below with reference to the attached drawing figures, and wherein.

DETAILED DESCRIPTION

Figure 1:
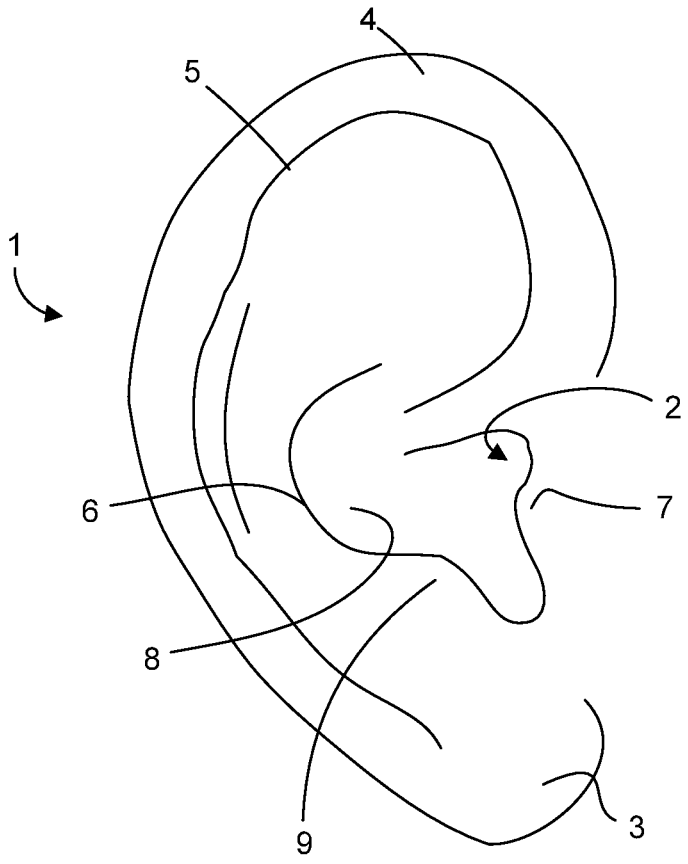
FIG. 1 is a diagram depicting the pinna or outer portion of a human ear and parts thereof.
Figure 2:
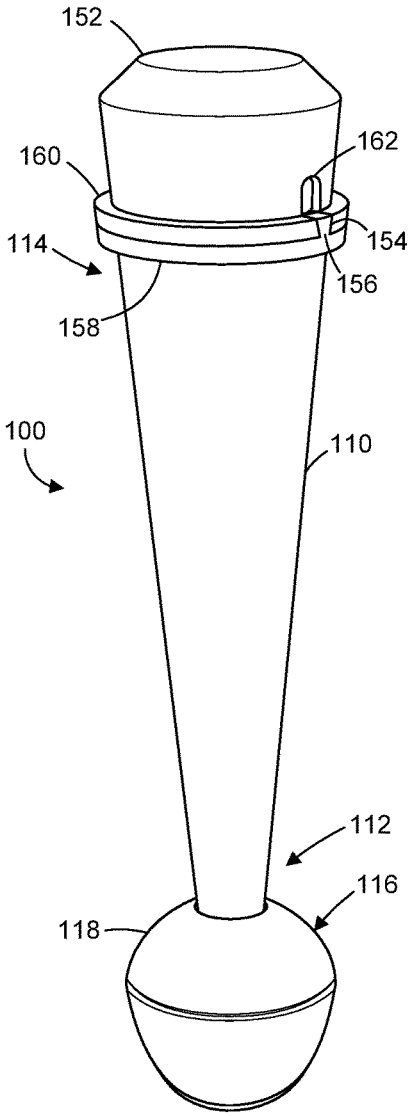
FIG. 2 is a perspective view of an audio device configured as a taper-style earring depicted in accordance with an exemplary embodiment.

The subject matter of select exemplary embodiments is described with specificity herein to meet statutory requirements. But the description itself is not intended to necessarily limit the scope of claims. Rather, the claimed subject matter might be embodied in other ways to include different components, steps, or combinations thereof similar to the ones described in this document, in conjunction with other present or future technologies. Terms should not be interpreted as implying any particular order among or between various steps herein disclosed unless and except when the order of individual steps is explicitly described. The terms "about" or "approximately" as used herein denote deviations from the exact value by +/−10%, preferably by +/−5% and/or deviations in the form of changes that are insignificant to the function.

Exemplary embodiments are described herein with respect to the drawings in which reference numerals are employed to identify particular components or features. Corresponding elements in the various embodiments depicted are provided with reference numerals having matching second and third digits but with differing first digits, e.g. element 10 corresponds to elements 110, 210, etc. Such is provided to avoid redundant description of corresponding features of the elements but is not intended to indicate the features or elements are necessarily the same.

With initial reference to FIG. 1, an external portion or pinna 1 of a human ear is depicted. The pinna 1 comprises a soft appendage generally comprised of cartilage and soft or fleshy tissues that collect and direct sound toward the ear canal 2 for receipt by the inner ear as known in the art. A variety of portions of the pinna 1 may be pierced for insertion of body jewelry. For example, the lobe 3 comprises fleshy tissues such as skin, and may be pierced for insertion of an earring or body jewelry such as a taper- or gauge-style earring. Hereinafter, earrings and body jewelry that are insertable in a piercing in the pinna 1 are collectively referred to as earrings. The helix 4, scapha 5, antihelix 6, tragus 7, concha 8, and antitragus 9 are cartilaginous portions of the pinna 1 that can be pierced for insertion of earrings known as an industrial, spiral, rook, tragus, and conch, among others.

With reference now to FIGS. 2-8, an audio device 100 that is wearable in a piercing in the pinna 1 of the ear is described in accordance with an exemplary embodiment. The audio device 100 is configured as a taper-style earring and includes a body 110 having a generally conical form. The conical form provides a first end 112 of the body 110 with dimensions that are smaller than those of an opposite second end 114. Although the body 110 is described herein as including a linear or straight conical taper-style form, it is to be understood that the body 110 can take a variety of different taper-style forms including for example, curved, spiral, claw, or horn shaped tapers among others. The body 110 includes a substantially hollow interior space and is removably coupled at the first end 112 to a control unit 116.

The control unit 116 includes a housing 118 having dimensions larger than the first end 112 of the body 110, e.g. the housing 118 has a diameter that is larger than the diameter of the first end 112 of the body 110, but the housing 118 can have any desired dimensions—larger or smaller than those of the body 110. The housing 118 is preferably configured in a spheroidal form but any desired form can be employed. The size and shape of the housing 118 may aid in avoiding inadvertent withdrawal of the audio device 100 from the piercing. Other components might also or alternatively be employed to avoid inadvertent withdrawal and/or to maintain positioning of the body 110 in the piercing, such as rubber O-rings.

Figure 5:
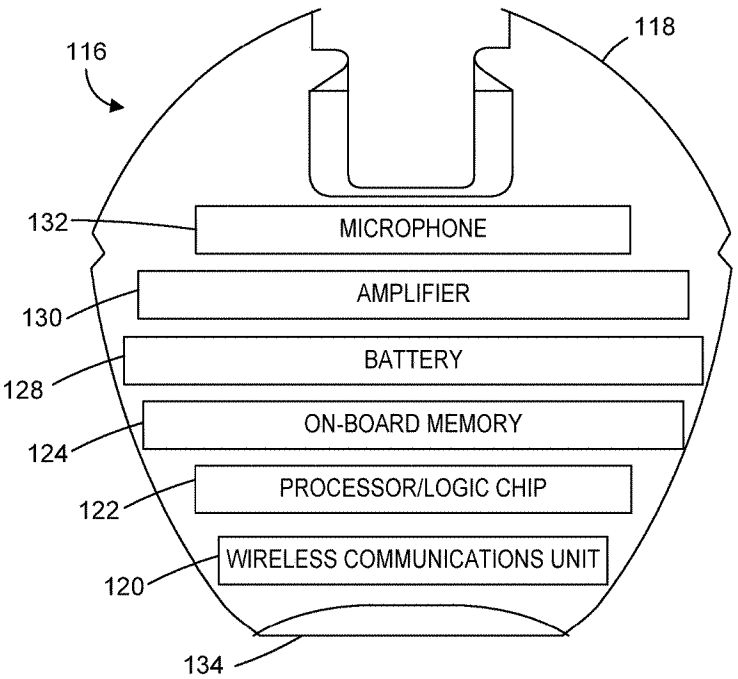
FIG. 5 is a block diagram depicting components of a control unit of an audio device depicted in accordance with an exemplary embodiment.

As depicted in FIG. 5, a variety of components are disposed in the housing 118 and configured for operation of the audio device 100 including a wireless communications unit 120, a processor or logic chip 122, an on-board memory 124, and a battery 128. An amplifier 130, a microphone 132, and/or a sensor 113 might also be included, among a variety of other components. It is to be understood that one or more of these components can be combined or their functions performed by another component. For example, processors can include memory. Although only one of each of these components is shown, more than one may be provided and such additional components may be similarly or variously configured to provide the same or a different function. For example, a plurality of sensors 113 might be provided to detect different conditions, such as movements, location, biometric data, or the like. Additionally, detail of the connections and communications between the components is not necessary for conveying an understanding of exemplary embodiments and is not described in detail herein.

Figure 7:
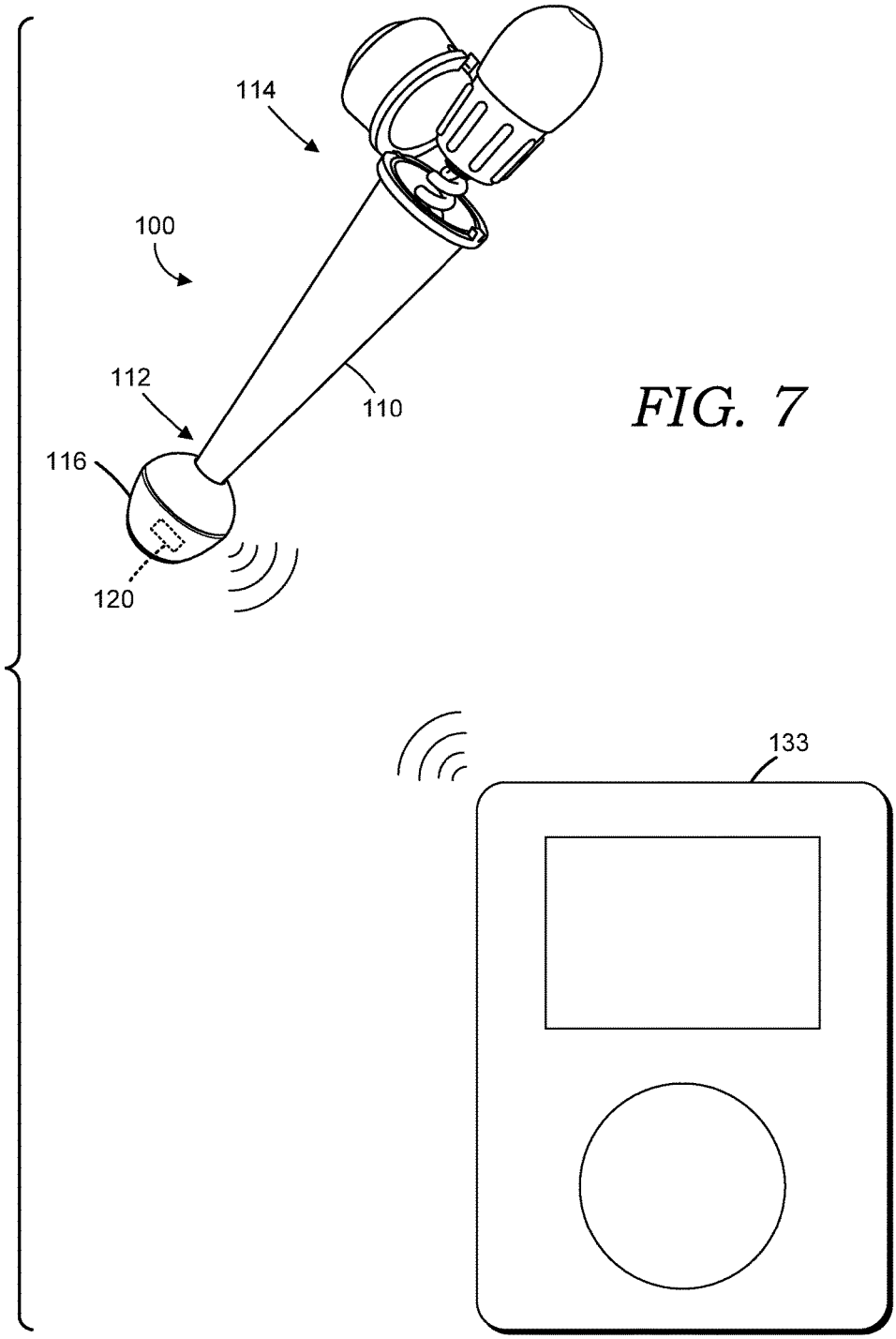
FIG. 7 is a diagrammatic view of wireless communications between a wireless communications unit disposed in a control unit of the audio device of FIG. 2 and a master device depicted in accordance with an exemplary embodiment.

The wireless communications unit 120 employs wireless communications protocols, standards, hardware, and the like, available in the art, such as, for example, the BLUETOOTH standards developed by the Bluetooth Special Interest Group. As shown in FIG. 7, the wireless communications unit 120 in the control unit 116 provides wireless communications between the audio device 100 and a master device 133 such as a digital music player, a cellular telephone, a computer, or similar electronic device. The master device 133 provides audio data, and control signals, among other communications to the audio device 100 via wireless communications with the wireless communications unit 120 for use by the audio device 100. The audio device 100 may also transmit a variety of communications to the master device 133 via the wireless communications unit 120 like, for example, handshake signaling for creating a secure connection therebetween, audio data collected by the microphone 132, or command signals to the master device 133, e.g. to change an audio file being played, among others.

The processor or logic chip 122 executes one or more programs or routines useable to produce an audible output using audio data received from the master device 133 via the wireless communications unit 120. The processor 122 may process audio inputs received from the microphone 132 for communication to the master device 133. Additionally, one or more control surfaces 134 can be provided on the audio device 100 from which the processor 122 can receive input commands. The control surfaces 134 can include touch interfaces, such as capacitive surfaces, buttons, switches, rotatory dials, or the like and enable a user to provide inputs to the audio device 100 or to the master device 133. In one embodiment, a capacitive touch interface is provided in a base or distal end of the housing 118. In another embodiment, a lower portion of the housing 118 is rotatable with respect to an upper portion or with respect to the body 110 to provide input to the audio device 100 or to the master controller. For example, a user might provide an input to change an audio track being played, to increase a volume of the audio output, or to interact with an application executing on the master device 133.

The on-board memory 124 is useable by the processor 122 for execution of programs and routines but is not configured to provide storage of audio or other data for later playback, e.g. the memory 124 cannot be used to store audio data for a plurality of songs on the audio device 100 for later playback in a manner similar to a digital music player—such tasks are reserved for the master device 133. In another embodiment, the memory 124 can be configured for storage of one or more data or audio files.

Figure 14:
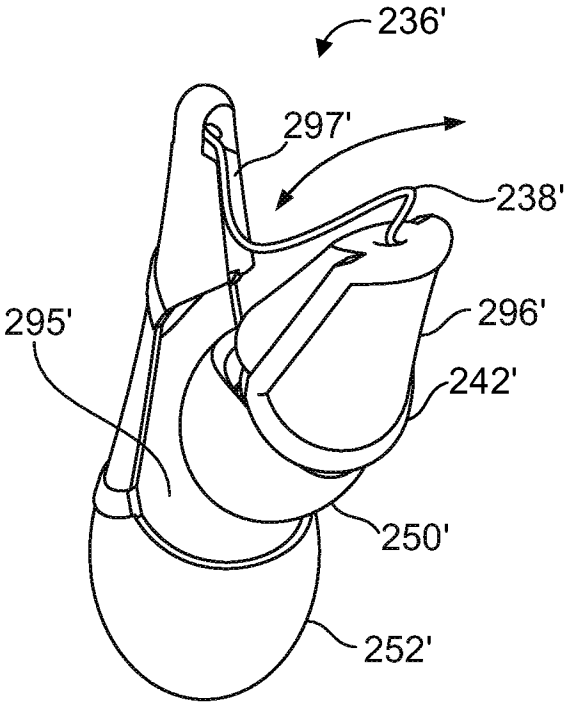
FIG. 14 is a perspective view of the sound-production unit of FIG. 13 in a use orientation.
Figure 13:
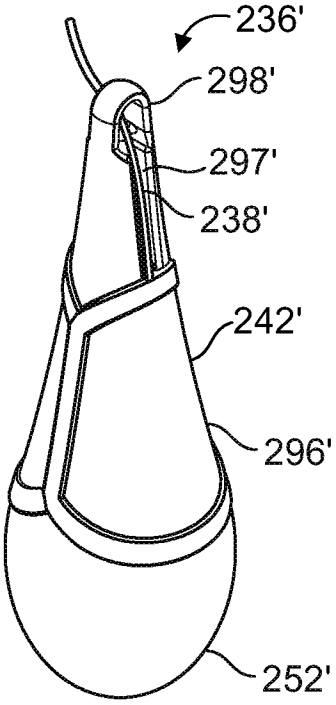
FIG. 13 is a perspective view of another sound-production unit in a non-use orientation and depicted in accordance with an exemplary embodiment.
Figure 16:
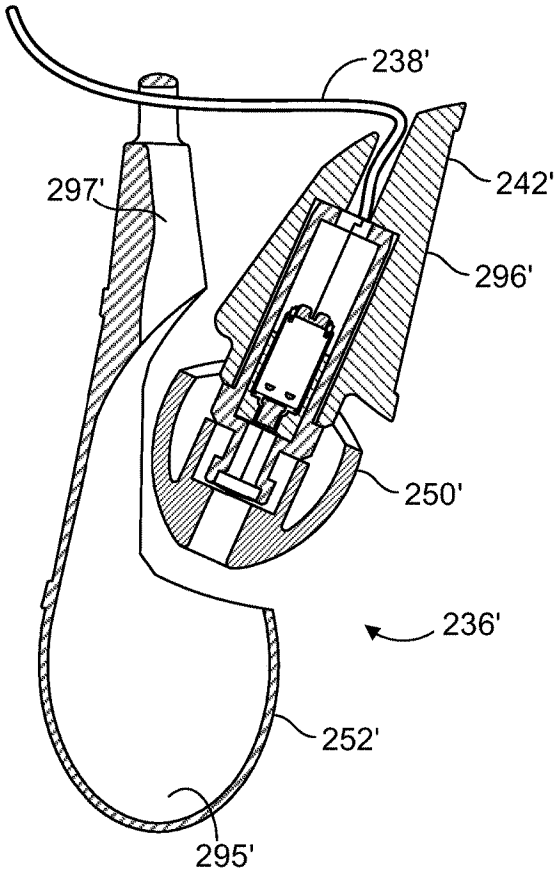
FIG. 16 is a cross-sectional view of the sound-production unit of FIG. 14 depicted in accordance with an exemplary embodiment.
Figure 15:
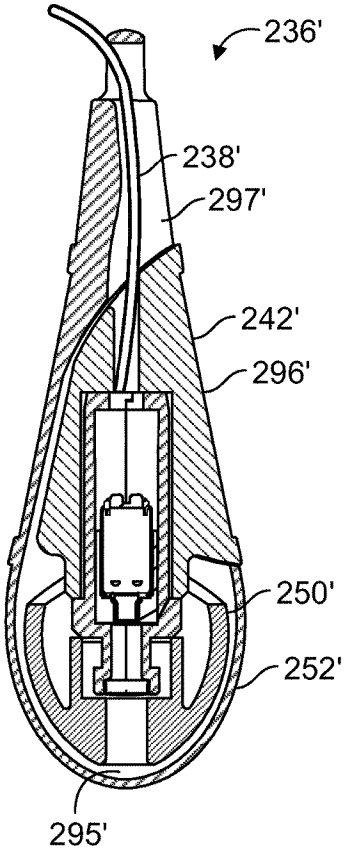
FIG. 15 is a cross-sectional view of the sound-production unit of FIG. 13 depicted in accordance with an exemplary embodiment.

The amplifier 130 is employed by the processor 122 to provide outputs useable by a sound-production unit 136 disposed proximate the second end 114 of the body 110. The output of the amplifier 130 comprises electrical signals, which may be amplified, that are communicated to the sound-production unit 136 via an electrical wire or conductor 138 in a known manner. However, the control unit 116 might also be configured to provide outputs to the sound-production unit 136 as air pressure waves carried by a hollow conduit, or as light rays carried by fiber-optic conduits. In one embodiment, the body 110 functions as the electrical wire or conductor 138 (see FIG. 14D) or as the conduit for carrying the pressure waves or optical signals.

The microphone 132 is any available microphone useable to receive audio inputs from a user including, for example, vocalizations provided during a telephone call as well as voice commands to the master device 133 when such capabilities are present in the master device 133. Additional microphones 132 may be provided at disparate locations on the audio device 100 for use in collecting audio inputs from a user's surroundings or environment, such as in the body 110 or in the sound-production unit 136. Such audio inputs are useable by the processor 122 or the master device 133 for noise cancellation among other uses.

Figure 4:
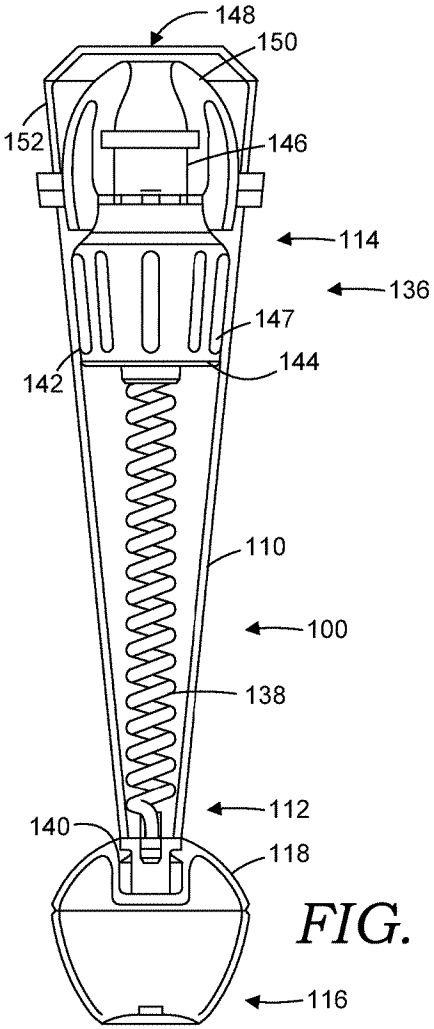
FIG. 4 is an elevational view of the audio device of FIG. 2 depicted with exterior walls removed to reveal components disposed therein.

With continued reference to FIG. 4, the control unit 116 is removeably coupled to the first end 112 of the body 110. The coupling can be a threaded coupling provided by mating threads on the first end 112 of the body 110 and a receptacle 140 in the housing 118 of the control unit 116. Or the body 110 and the housing 118 can include any of a variety of mating flanges, tabs, grooves, slots, or the like that enable snap-fit, friction-fit, magnetic fit, or other engageable couplings. The coupling places the control unit 116 in communication with the conductor 138 by, for example, placing metallic contacts on the first end 112 of the body 110 in contact with mating contacts disposed within the receptacle 140 of the housing 118.

Figure 8:
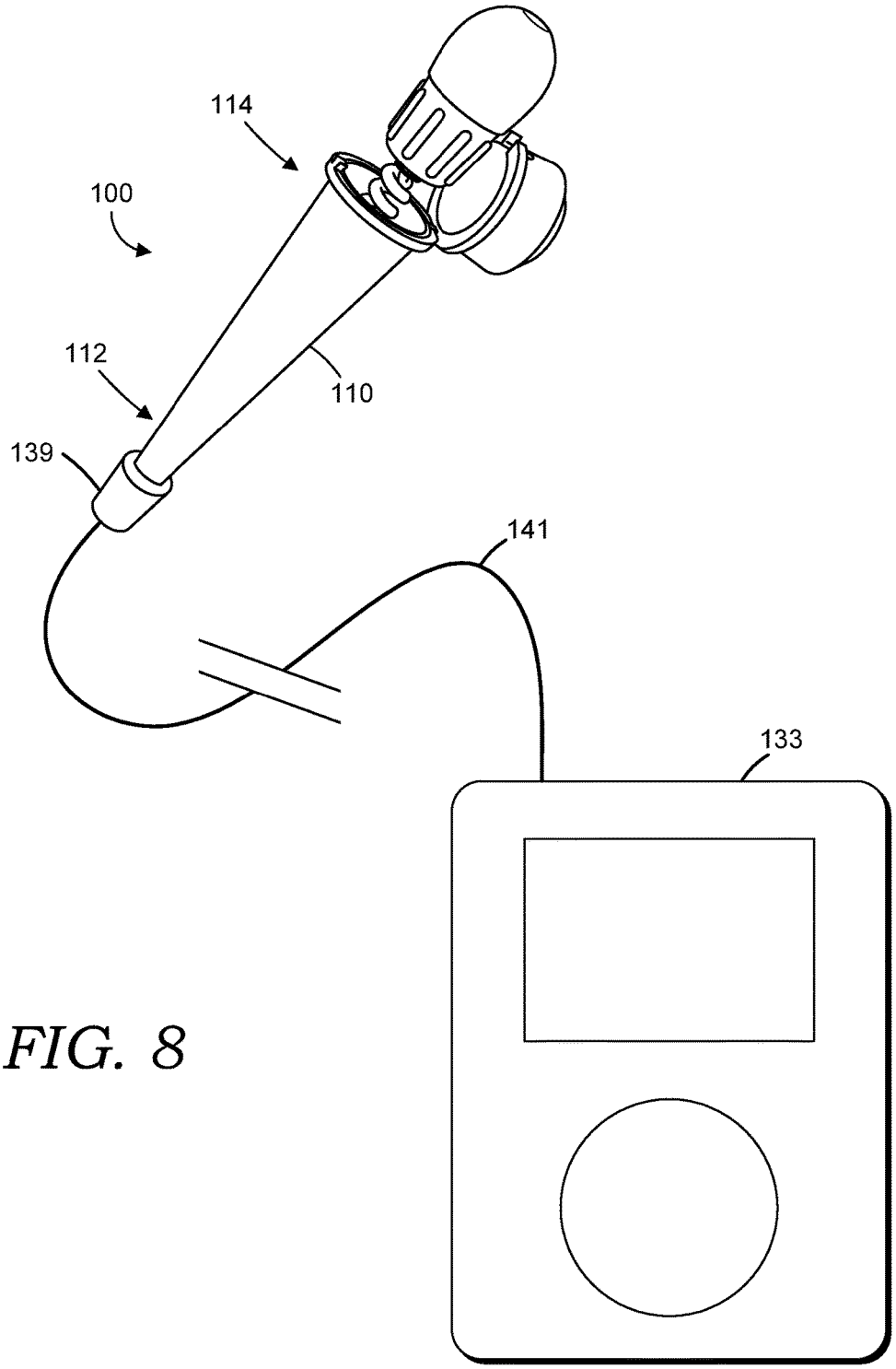
FIG. 8 is a diagrammatic view depicting a wired connection between the audio device of FIG. 2 and a master device in accordance with an exemplary embodiment.
Figure 9:
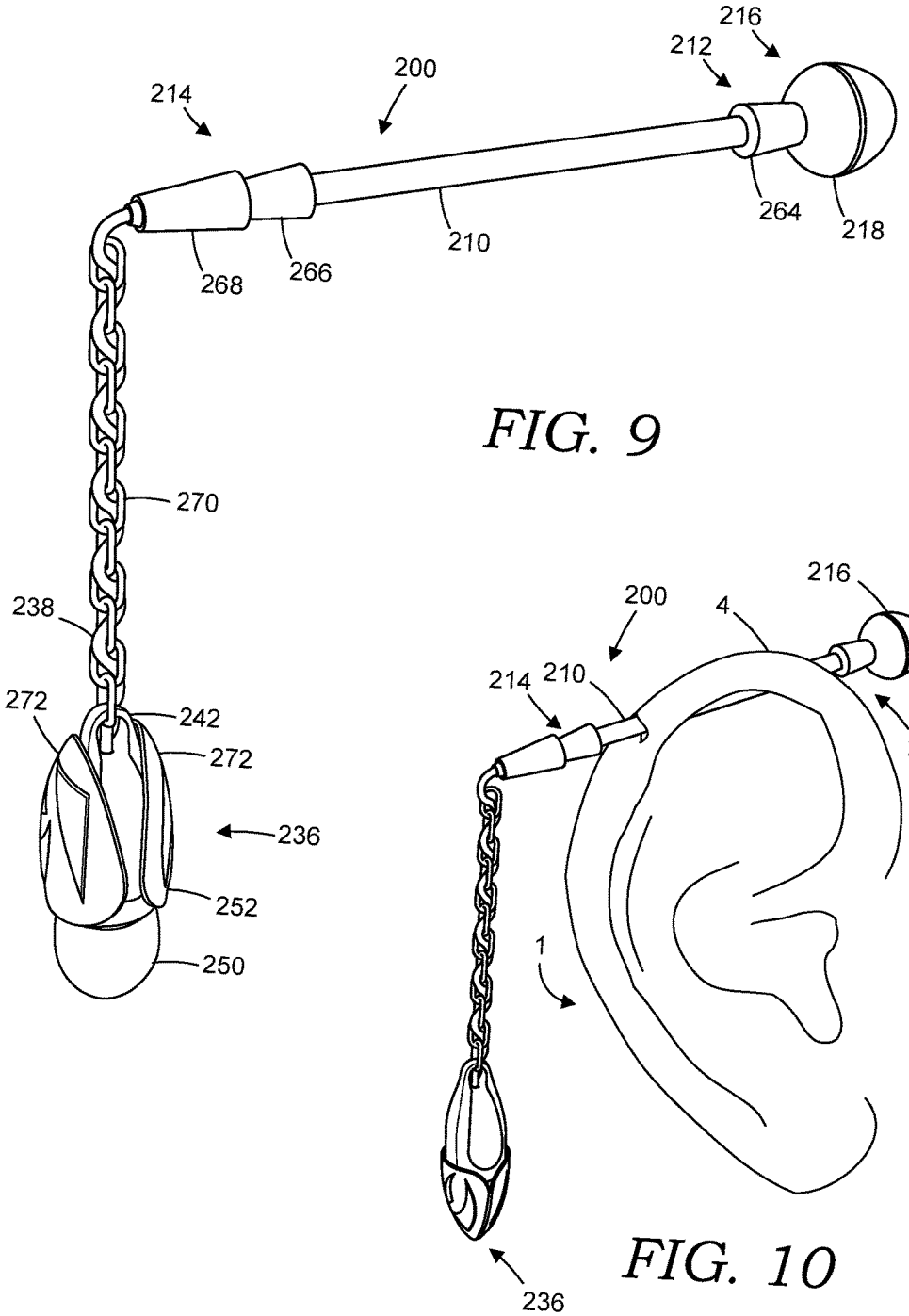
FIG. 9 is a perspective view of an audio device configured as an industrial-style earring depicted in accordance with an exemplary embodiment.

As seen in FIG. 8, the first end 112 of the body 110 may also be configured to receive a wire 141 or other conductor for connection to the master device 133 when the control unit 116 is removed therefrom. The threads, flanges, tabs, or other features on the first end 112 of the body 110 for coupling to the housing 118 of the control unit 116 as well as the contacts for coupling to the conductor 138 can be employed for coupling with a receiver 139 on an end of a wire 141. Such a wired coupling might be employed when wireless communications are restricted, e.g. such as on an airplane, but use of the audio device 100 is desired.

Figure 6:
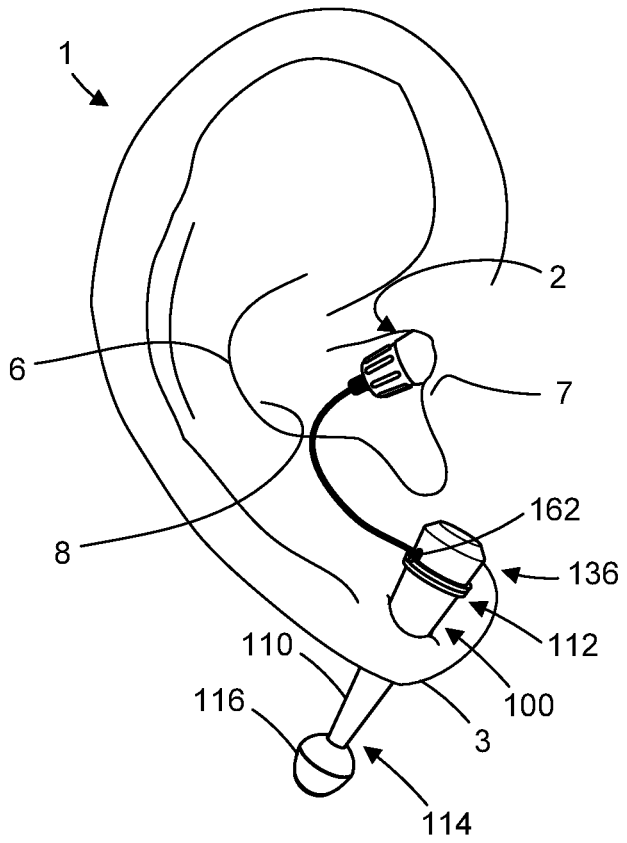
FIG. 6 depicts the audio device of FIG. 2 disposed in a piercing in the lobe of an ear with an audio-production device disposed to direct audio outputs toward the ear canal in accordance with an exemplary embodiment.

Now referring back to FIG. 4, the conductor 138 is coupled to the first end 112 of the body 110 within the interior thereof and extends through the interior of the body 110 toward the second end 114 and couples to the sound-production unit 136. The conductor 138 is flexible and may be extensible to enable the conductor 138 to extend a distance from within the body 110 sufficient to place a distal end of the sound-production unit 136 in proximity to the ear canal 2 of a user wearing the audio device 100 in the pinna 1 of the user's ear. As shown in FIG. 6, the sound-production unit 136 is disposed in the pinna 1 in a space defined by the antihelix 6, concha 8, and tragus 7 and is directed toward or into the ear canal 2.

Figure 3:
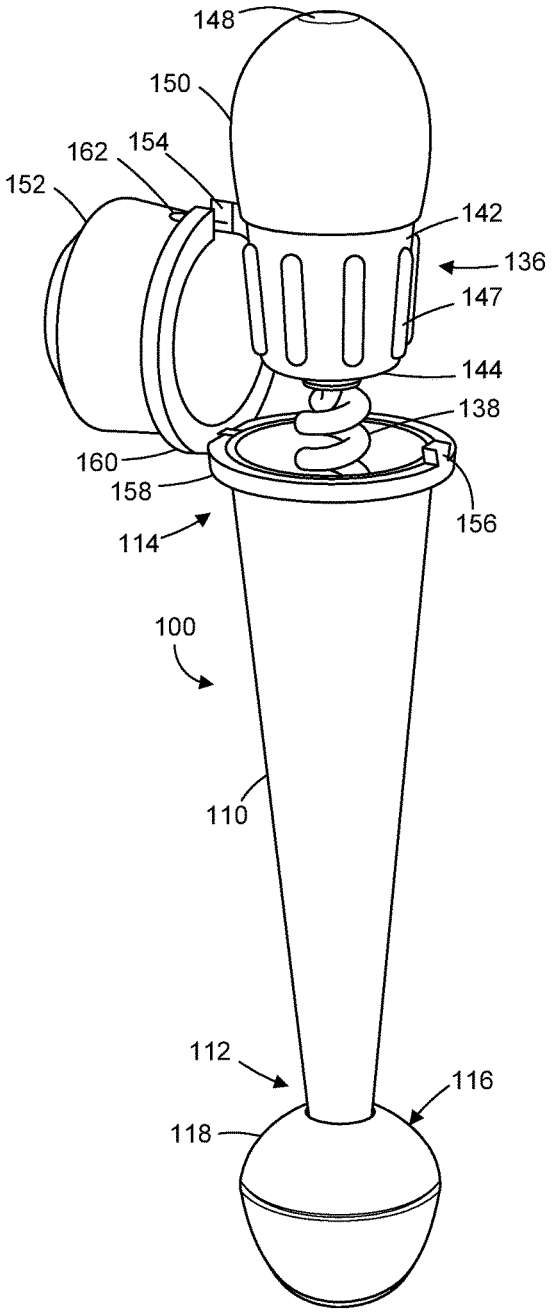
FIG. 3 is a perspective view of the audio device of FIG. 2 depicted with a cover in an open position and a sound-production unit extending from an end of the device.

As depicted in FIGS. 3 and 4 the conductor 138 is provided in a spiral or helical configuration to provide sufficient length to the conductor 138 while also enabling retraction of the conductor 138 into the body 110. The conductor 138 can alternatively be provided in any desired configuration that enables extension and retraction thereof as described herein. For example, the conductor 138 might be disposed on a coil or spool within the body 110 that feeds out the conductor 138 when needed. The conductor 138 may have a memory or may be coated with a resilient coating having a memory to at least partially bias the conductor 138 toward the retracted, spiraled configuration. Such may aid retraction of the conductor 138 into the body 110 when desired. The conductor 138 is flexible and non-supporting in that the conductor 138 has sufficient tensile strength to support the sound-production unit 136 in a suspended or hanging position but has insufficient compressive or flexural strength to support or retain the sound-production unit 136 in positions vertically above the suspended position.

The sound-production unit 136 includes a housing 142 comprising a base 144 with a nipple 146 extending from a distal end thereof. The sound-production unit 136 further includes a speaker, transducer, driver, or other sound production components (hereinafter referred to generally as a speaker) disposed in the housing 142 and configured to produce an audible output. Other components, such as an amplifier, microphone, or the like might also be disposed in the sound-production unit 136.

The base 144 of the sound-production unit housing 142 is configured with a frusto-conical form that is dimensioned to fit within the conical shape of the housing 110 and to be received at least partially therein. As depicted in FIG. 4, the base 144 is received into the body 110 a distance sufficient to leave only a portion of the nipple 146 extending from the body 110. A plurality of ribs 147, ridges, or other protuberances are provided along the perimeter of the base 144. The ribs 147 may provide a friction-fit between the interior of the housing 110 and the housing 142 to removeably retain the housing 142 therein as well as provide a cushion between the housing 142 and the body 110. The ribs 147 may also provide an air gap between the housing 142 and the body 110 to avoid the housing 142 becoming stuck in the body 110 as a result of entrapment of air within the body 110. The ribs 147 or similar features might also be configured to provide a snap-fit, mechanical coupling, or magnetic coupling to aid retention of the sound-production unit 136 in the housing 110.

The conductor 138 is coupled to a proximate side of the base 144 of the housing 142 and to the speaker (not shown) or other components disposed therein. In an embodiment, one or more of the components of the control unit 116 may be disposed in the housing 142 and coupled to the conductor 138.

The nipple 146 extends from the distal side of the housing 142 and includes a central aperture 148 through which sound produced by the speaker is directed and emitted from the sound-production unit 136. An exterior of the nipple 146 is configured to removeably engage an ear tip 150. Although the nipple 146 is shown and described herein as extending from the distal end of the base 144, such is not intended to so limit exemplary embodiments. For example, the nipple 146 may comprise any structure on the base 144 to which the ear tip 150 may be coupled; the nipple 146 need not necessarily extend from the base 144.

The ear tip 150 comprises a generally dome-shaped portion of a soft, pliable material that surrounds the nipple 146 but does not substantially obstruct the central aperture 148. The ear tip 150 may also be referred to in the art as an earbud, ear plug, ear piece, or the like. The ear tip 150 provides cushioning to produce a comfortable fit for the user when the sound-production unit 136 is at least partially inserted in the pinna 1. The ear tip 150 may also provide some frictional characteristics to aid retention of the sound-production unit 136 in the pinna 1 and/or ear canal 2 as well as blocking of environmental noises or sounds from entering the ear canal 2. The ear tip 150 can be produced in any desired form and from available materials known in the art. For example, the ear tip 150 can be uniquely molded to a particular user's pinna 1, or can be formed from compressible memory-foam, silicon, or rubber materials, among others.

A cover 152 is provided on the second end 114 of the body 110. The cover 152 is pivotally or hingedly coupled to the body 110 to enable pivoting thereof from a closed position (FIGS. 2, 4, and 6) covering and enclosing the sound-production unit 136 within the body 110 and an open position (FIGS. 3 and 7-8) in which the sound-production unit 136 can be removed from within the body 110. In another embodiment, the cover 152 is removeably coupled to the body 110 to allow the cover 152 to be detached therefrom.

The cover 152 may include a notch 154 in an edge thereof that is configured to engage a mating tab 156 or flange depending from the perimeter of the second end 114 of the body 110. Annular flanges 158, 160 are provided about the perimeters of the second end 114 of the body 110 and the cover 152, respectively, on which the notch 154 and the tab 156 can be disposed. Frictional, mechanical, and/or magnetic engagement between the notch 154 and the tab 156 releasably retain the cover 152 in the closed position. In another embodiment, a clasp or similar mechanical closure is provided to retain the cover 152 in the closed position.

As shown in FIG. 6, the notch 154 extends a distance along the sidewall of the cover 152 to provide an aperture 162 through which the conductor 138 can be disposed when the sound-production unit 136 is extended from the body 110 and the cover 152 is in the closed position. One of skill in the art will recognize other ways or forms of providing the described features; such other forms are understood as being within the scope of exemplary embodiments described herein.

With continued reference to FIGS. 2-8, operation of the audio device 100 is described in accordance with an exemplary embodiment. The audio device 100 is installed in a piercing in the pinna 1 of the user's ear as depicted in FIG. 6. In some embodiments, two of the audio devices 100 are worn simultaneously, one in each ear of the user, to provide audio outputs to each ear, such as to provide stereo sound. When the audio device 100 comprises a taper-style earring, as described previously, the audio device 100 is usually installed in a piercing in the lobe 3 of the ear. The control unit 116 is removed from the first end 112 of the body 110 and the body 110 inserted through the piercing. The audio device 100 is typically positioned with the first end 112 extending through the lobe 3 to a position between the ear and the head of the user although the reverse placement can be employed. The control unit 116 is recoupled to the body 110. Or a receiver 139 of a wired connection 141 can be coupled to the first end 112 of the body 110 and connected to the master device 133 as shown in FIG. 8.

The audio device 100 is thereby substantially captured by the interaction of the conical form of the body 110 and the enlarged dimensions of the housing 118 of the control unit 116. The dimensions of the second end 114 of the body 110 and of the housing 118 are preferably larger than that of the piercing into which the audio device 100 is inserted. The audio device 100 can be drawn at least partially through the piercing to at least partially stretch the lobe 3 and thereby provide some frictional engagement therebetween. The annular flange 158 on the body 110 can provide an additional obstruction to passage of the second end 114 of the body 110 through the piercing.

The cover 152 is pivoted to the open position and the sound-production unit 136 is withdrawn from within the body 110. The sound-production unit 136 is extended from the body 110 and placed at least partially into a space in the pinna 1 proximate the ear canal 2 and defined by the by the antihelix 6, concha 8, and tragus 7 and directed toward the ear canal 2 of the user. The sound-production unit 136 may be inserted at least partially into the ear canal 2. The conductor 138 extends from the sound-production unit 136, into the body 110 and to the first end 112 thereof to communicatively couple with the control unit 116. The cover 152 can be returned to the closed position with the conductor 138 disposed in the aperture 162. As such, the audio device 100 retains an attractive ornamental appearance of an earring during use for production of audio outputs from the sound-production unit 136.

An initial setup of the audio device 100 with the master device 133 may be carried out. The setup may include a series of communications between the audio device 100 and the master device 133 to complete processes, such as pairing among others known in the art for providing wireless communications between such devices. Description of such processes is not necessary for an understanding of exemplary embodiments and is thus not provided herein.

Using the master device 133 the user selects an audio file or track to be played by the master device 133. The master device 133 wirelessly (or through the wired connection 141) transmits or streams the audio file to the audio device 100 via the wireless communications unit 120. The wireless communications unit 120 receives the audio file for use by the control unit 116 to generate signals to the sound-production unit 136 for production of an audible output therefrom. As such, the signal path of signals embodying the audio file received from the master device 133 travels from a first side of the pinna 1, through the body 110 of the audio device 100 and thus through the pinna 1, and through the conductor 138 to the space proximate the ear canal 2 or in the ear canal 2 where the audio output is finally provided.

The user might alternatively employ the control surfaces 134 on the audio device 100 to instruct the master device 133 to begin playing a desired audio track, skip to a next or a previous track, pause, rewind, fast-forward, or stop playing an audio track. The user might also use the control surfaces 134 to navigate menus, interact with software applications, answer incoming telephone calls, provide voice commands, or the like.

When use of the audio device 100 to provide an audio output is not desired, the sound-production unit 136 and conductor 138 are returned to the body 110 and the cover 152 moved to the closed position. As such, the audio device 100 is wearable as an ornamental earring. The body 110, housing 118 of the control unit, and cover 152 can include any desired exterior ornamentation to enhance the appearance of the audio device 100. When not in use for audio output production, the sound-production unit 136 is completely enclosed and hidden from view.

Figure 10:
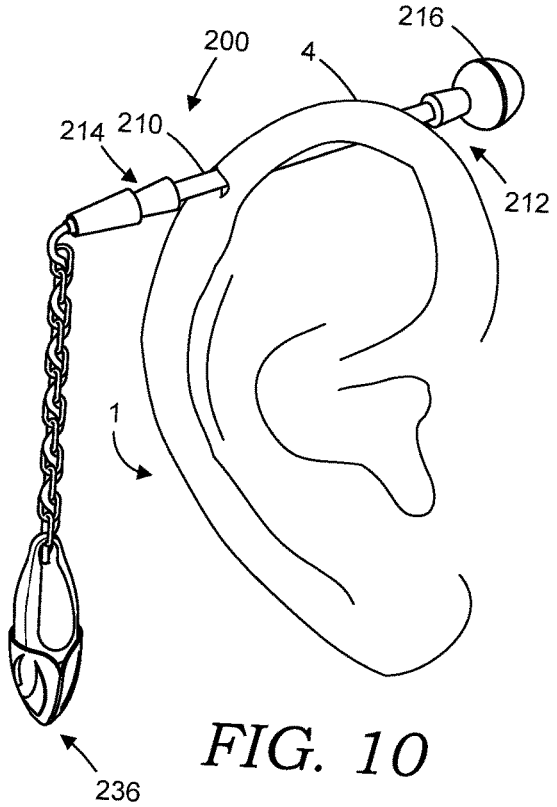
FIG. 10 depicts the audio device of FIG. 9 disposed in a pair of piercings in the helix of an ear in accordance with an exemplary embodiment.
Figure 11:
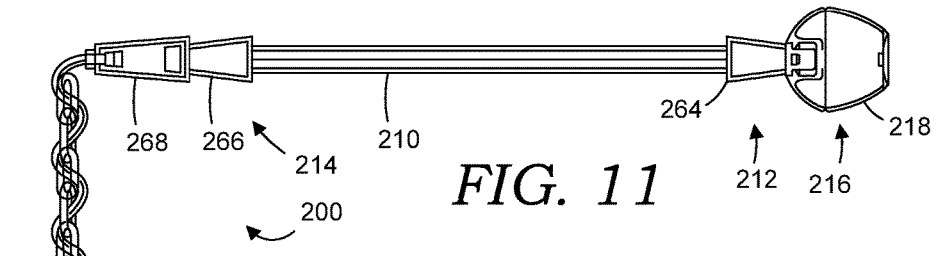
FIG. 11 is an elevational view of the audio device of FIG. 9 depicted with exterior walls removed to reveal components disposed therein.

With reference now to FIGS. 9-12, an audio device 200 is described in accordance with another exemplary embodiment. The audio device 200 is configured as an industrial-style earring. Industrial-style earrings are typically inserted through a pair of piercings in the helix 4 or other cartilaginous portions of the pinna 1, as shown in FIG. 10. The body 210 of the audio device 200 comprises an elongate cylindrical form with first and second connectors 264, 266 disposed at the first and second ends 212, 214 thereof, respectively. The first connector 264 removeably couples the body 210 with the control unit 216 and the second connector 266 removeably couples the second end 214 of the body 210 with the conductor 238 in a manner similar to that described above with respect to the audio device 100 for connecting the first end 112 of the body 110 with the control unit 116.

The first and second connectors 264, 266 are conical members having a diameter that is larger than the diameter of the body 210, but in other embodiments can have another shape and dimension. As such, when installed in the pinna 1 of the user, the first and second connectors 264, 266 may act to obstruct passage of the body 210 through the piercings. One or both of the first and second connectors 264, 266 may also be removeably coupled to the body 210 to enable removal thereof for installation of the body 210 in the pinna 1. Alternatively, the conical shape of the connectors 264, 266 may aid insertion of the connectors 264, 266 and the body 210 through the piercings by stretching of the piercings.

The conductor 238 of the audio device 200 includes a receiver 268 at one end thereof that couples the conductor 238 to the second connector 266 and thus, to the body 210 which forms or provides a second segment of the conductor 238 extending through or along the body 210. The sound-production unit 236 is coupled to the opposite end of the conductor 238 and thus is suspended from the second end 214 of the body 210 via the conductor 238. The second segment of the conductor 238 thus continues the path of the conductor 328 between the sound-production unit 236 and the control unit 216 or to a wired coupling with a master device (see the wired coupling 141 and the master device 133 depicted in FIG. 8).

A chain 270 or other non-extensible member can be intertwined with, disposed alongside, or otherwise associated with the conductor 238. The chain 270 may provide additional support for the sound-production unit 236 as it is suspended and/or may be provided to enhance aesthetic qualities of the conductor 238. The chain 270 may be coupled to the receiver 268 and to the base 244 of the housing 242.

Figure 12:
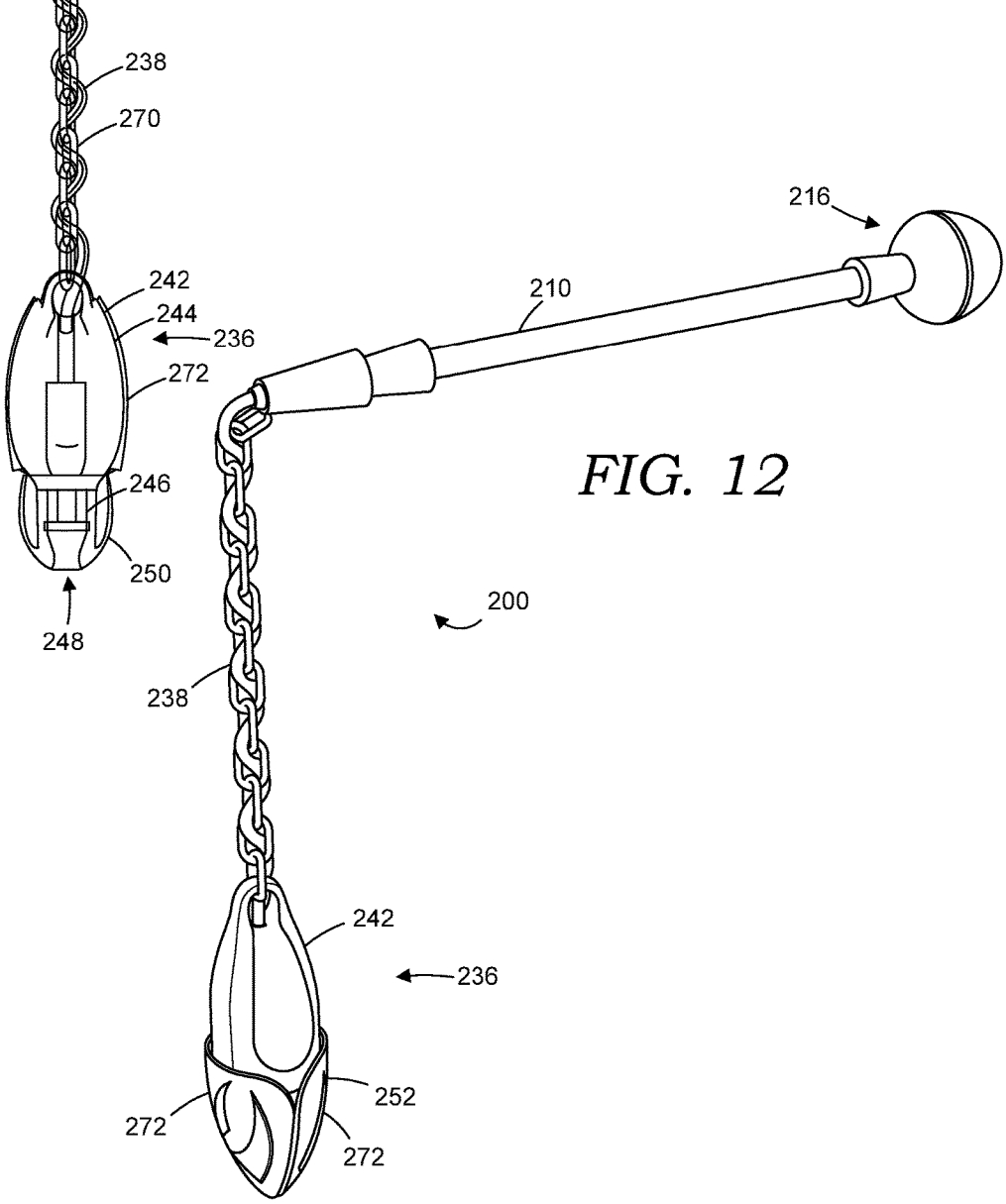
FIG. 12 is a perspective view of the audio device of FIG. 9 depicting a cover enclosing a sound-production unit.

The cover 252 comprises a pair of actuatable halves, shells, or leaves 272 that are moveable from a use position (FIGS. 9 and 11) to a non-use position (FIGS. 10 and 12). In the use position, the leaves 272 are disposed alongside the base 244 of the housing 242 to expose the ear tip 250 and not interfere with insertion thereof into the ear canal 2 of the user. The leaves 272 are shaped to generally mimic the shape of the ear tip 250 and the base 244 of the housing 242. As such, the leaves 272 can lie substantially alongside and in close proximity to the sides of the base 244. In the non-use position, the leaves 272 are rotated or pivoted to extend toward a distal end of the sound-production unit 236 and to substantially enclose the ear tip 250 therebetween. In another embodiment, the cover 252 comprises a cap that is mechanically or magnetically coupled to the housing 242 and may be removable therefrom.

In use, the audio device 200 is disposed in the pinna 1 of the user's ear, as depicted in FIG. 10. When use of the audio device 200 for audio output is desired, the leaves 272 are rotated from the non-use position to the use position to expose the ear tip 250. The sound-production unit 236 is placed in the space proximate to the ear canal 2 and the audio device 200 is operated as described previously above with respect to the audio device 100. As such, the signal path of signals embodying the audio file received from the master device 233 travels from a first side of the pinna 1 through the body 210 of the audio device 200 and thus passes through the pinna 1 two times before passing through the conductor 238 to the space proximate the ear canal 2 where the audio output is finally provided.

When use of the audio device 200 for audio output is no longer desired, the sound-production unit 236 is removed from the space proximate the ear canal 2 and the leaves are returned to the non-use position. The sound-production unit 236 is then allowed to dangle or suspend from the second end of the body 210, as shown in FIG. 10. The housing 242, the leaves 272, and the chain 270 may be provided with an ornamental appearance to enhance the attractiveness of the audio device 200 as an earring. If desired, one or both of the conductor 238 with the sound-production unit 236 and the control unit 216 can be removed from the body 210 and the body 210 worn alone as an earring.

With additional reference now to FIGS. 13-16, the sound-production unit 236 useable with the audio device 200 may take a variety of forms. Embodiments of the sound-production unit 236 are described hereinafter using 200 series reference numerals, however such is not intended to limit use of the described sound-production units to the audio device 200. A sound-production unit 236' is described in accordance with an exemplary embodiment. The sound-production unit 236' can be used with and coupled to the first or second connectors 264, 266 on the body 210 configured as an industrial, swirl, or other style piercing. The sound-production unit 236' includes a speaker housing 242' that is removeably insertable into a cover 252'.

The cover 252' includes an interior hollow 295' shaped and dimensioned to receive the speaker housing 242', including the ear tip 250', in a generally form fitting manner. As depicted in FIGS. 13-16, the speaker housing 242' and ear tip 250' are directed generally downward within the cover 252' however, other orientations may be employed. The interior hollow 295' is open for receipt of the speaker housing 242' along a side of the cover 252'. The speaker housing 242' is inserted in a downward and inwardly rotating manner to place the center of gravity of the speaker housing 242' generally centrally within or just beyond the center of the interior hollow 295' of the cover 252' to aid retention of the speaker housing 242' therein. In one embodiment, the interior hollow 295' is sized just smaller than the ear tip 250' in at least one dimension. As such the ear tip 250' is at least partially compressed in at least one dimension to provide a frictional engagement between the ear tip 250' and an interior surface of the interior hollow 295' to aid retention of the ear tip 250' in the interior hollow 295'.

The speaker housing 242' includes an exposed surface 296' that is exposed to view when the speaker housing 242' is installed in the cover 252'. The exposed surface 296' and the exterior of the cover 252' may include any desired ornamentation and form to enhance the aesthetic appearance thereof. The speaker housing 242' and/or the exposed surface 296' may include one or more features, such as flanges, ribs, tabs, ridges, or the like that aid retention of the speaker housing 242' in the cover 252' and/or aid to disguise an interface therebetween that may be visible from the exterior of the sound-production unit 236'.

As shown in FIGS. 13-16, the cover 252' may include a channel 297' extending from the interior hollow 295' to a location adjacent a coupling loop 298' in which the conductor 238' extending between the speaker housing 242' and the remainder of the audio device 200' can be disposed. The channel 297' may be configured to receive a single run of the conductor 238' or the channel 297' can be configured to receive a plurality of runs of the conductor 238', for example by folding the conductor 238' back-and-forth along the channel 297'. A portion of the conductor 238' may also be disposed within the interior hollow 295' alongside the speaker housing 242' and/or ear tip 250'. The channel 297' may be dimensioned to retain the conductor 238' therein by friction fit and/or may include features such as ridges, coatings, pads, or the like to aid retention of the conductor 238' therein. The length of conductor 238' and thus the configuration of the channel 297' may be determined based on a desired length of the conductor 238' needed to enable insertion of the ear tip 250' into the ear canal 2 of the user.

The sound-production unit 236' thus includes a use and a non-use orientation. In the use orientation, generally shown in FIGS. 14 and 16, the speaker housing 242' is removed from the cover 252' by pivoting the speaker housing 242' outwardly and withdrawing the ear tip 250' from the interior hollow 295' of the cover 252'. For example, the speaker housing 242' may pivot or rotate about an edge of cover 252'. The ear tip 250' can then be moved to place the ear tip 250' into the pinna 1 and/or the ear canal 2 of the user for listening to audio produced by the audio device 200'. Movement of the speaker housing 242' away from the cover 252' also withdraws the conductor 238' from the channel 297' to provide sufficient slack for positioning the ear tip 250' in the user's ear canal 2.

When removed from the ear canal 2 the sound-production unit 236' is placed in the non-use orientation (depicted in FIGS. 13 and 55) by inserting the ear tip 250' into the interior hollow 295' and at least partially rotating the speaker housing 242' toward the cover 252'. The conductor 238' may also be installed into the channel 297' by pressing into place or may naturally fall or move into the channel 297' when the speaker housing 242' is inserted into the interior hollow 295'. As such, the ear tip 250' is hidden from view by the cover 252' and the exposed surface 296' of the speaker housing 242'. The cover 252' and the exposed surface 296' may be provided with any desired ornamentation to disguise the identity of the sound-production unit 236' as such and to provide the appearance thereof as being jewelry.

Several particular embodiments of the audio devices 100, 200, 300 are described herein. However, the scope of embodiments is not limited to the described forms of the audio devices 100, 200, 300. Embodiments of the audio devices 100, 200, 300 may employ other forms for the body 110, 210, 310 and may incorporate or combine various features of each of the audio devices 100, 200, 300 to provide a different configuration but with the same or combined functionalities.

With reference now to FIGS. 17-26, in another embodiment, an audio device 300 is configured as an integrated unit that can be disposed substantially entirely within the pinna 1 of a user's ear or more preferably at least partially within the ear canal 2 of the user's ear. The components of the audio device 300, such as the control unit 316 and the sound-production unit 336 are integrated or disposed in the body 310 such that the audio device 300 can be disposed and retained at least partially in the ear canal 2 of a user's ear in a use orientation. In a non-use orientation, the audio device 300 is removed from the user's ear and can be placed in a cover 352.

The components can be arranged and integrated to provide substantial size benefits. For example, in one embodiment, the audio device 300 is about 1.0 centimeter in overall length and weighs less than about 30 grams or preferably less than about 20 grams or more preferably less than about 10 grams. Such size enables the audio device 300 to be comfortably placed into the ear of the user without being highly visible to bystanders.

The body 310 of the audio device 300 has a generally cylindrical overall form with a diametrical or transverse cross-sectional dimension that is smaller than an interior diametrical dimension of a user's ear canal 2 such that the body 310 can be at least partially inserted into the ear canal 2. The dimensions of the body 300 may be configured based on average dimensions of user's ear canals 2 or may be selectable per user based on the particular user's ear canals 2. Description of the body 310 as being generally cylindrical is intended to be inclusive of forms including right cylinders, oblique cylinders with circular, ovular, polygonal, or other cross-sectional forms, as well as forms that may include a tapered, rounded, and/or truncated portions at either or both of ends 312, 314 thereof. For example, the body 310 may have a bullet-shaped or an ogive shaped end. The body 310 may also include a gripping feature 381 on the outer circumferential wall thereof near the first end 312. The gripping feature 381 comprises a recess or protuberance such as an annular groove that is engageable by, for example, a user's fingernail to withdraw the audio device 300 from the user's ear canal 2.

The control unit 316 is disposed within the first end 312 of the body 310. A control surface 334, such as a capacitive surface, may be provided on the first end 312 of the body 310 to allow the user to provide touch-based commands to the control unit 316. In one embodiment, a radar-based, non-touch control system is included in the control unit 316 to allow the user to provide commands via hand movements or gestures. Exemplary radar-based control systems include those developed by the Advanced Technology and Projects team at Google, Inc. referred to as Project Soli and described in U.S. Patent Application Publication Nos. 2016/0041617 (application Ser. No. 14/504,038) and 2016/0041618 (application Ser. No. 14/513,875).

Figure 18:
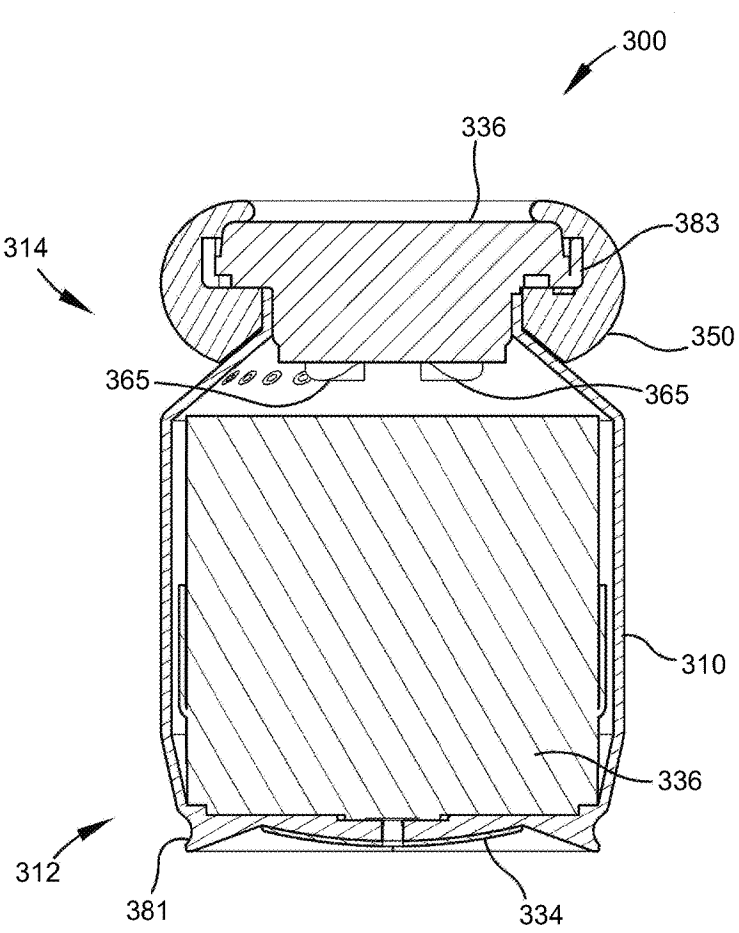
FIG. 18 is a cross-sectional diagram of the audio device of FIG. 17 taken along the line A-A depicted in accordance with an exemplary embodiment.
Figure 17:
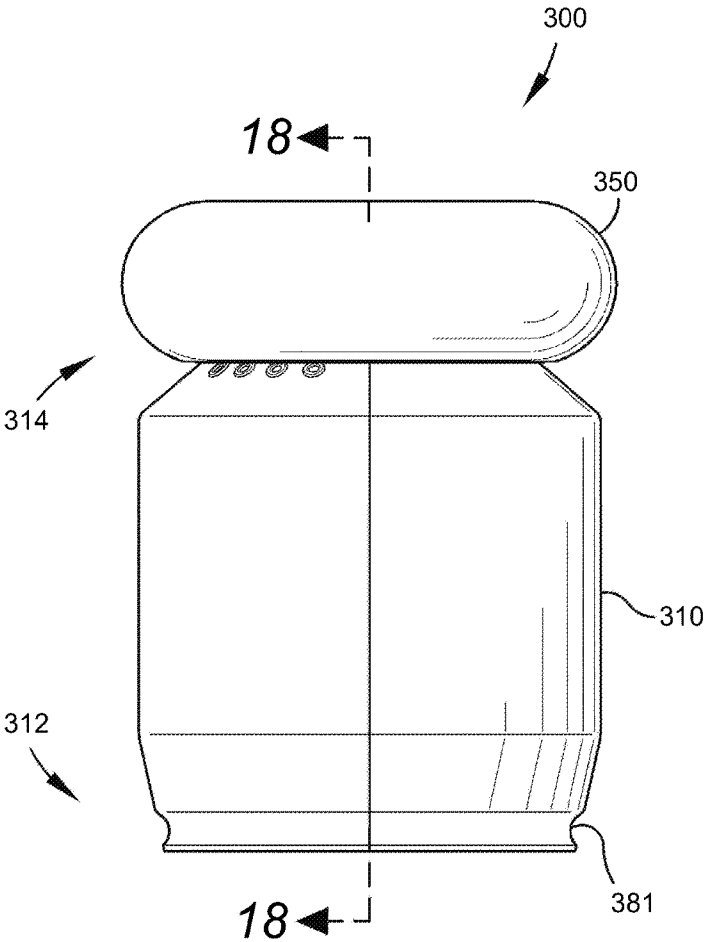
FIG. 17 is a side perspective view of an audio device configured as an integrated unit depicted in accordance with an exemplary embodiment.
Figure 20:
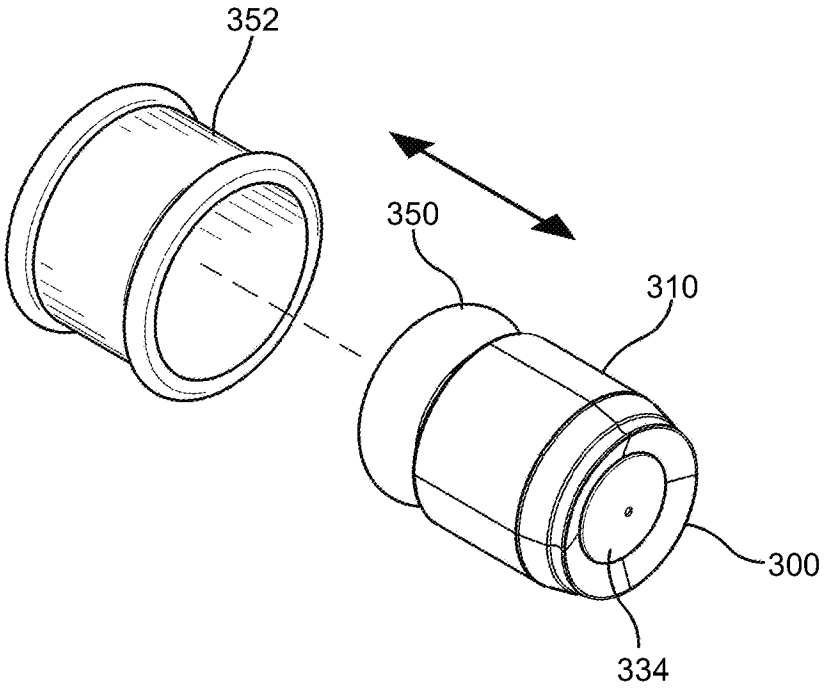
FIGS. 19 and 20 are perspective views of the audio device of FIG. 17 depicted within and removed from a cover that is configured as a gauge-style piercing in accordance with an exemplary embodiment.
Figure 19:
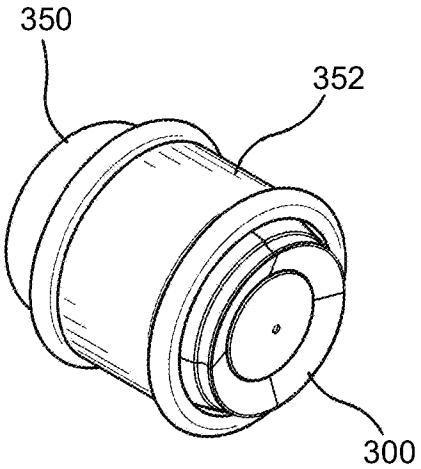

The sound production unit 336 is disposed at the second end 314 of the body 310. The sound production unit 336 may be partially disposed within the second end 314 of the body 310 or may couple to the second end 314. In one embodiment, the sound production unit 336 is directly electrically coupled to and/or mounted on a circuit board forming an end of the control unit 316 which may aid in reducing the size of the audio device 300. As depicted in FIG. 18, only a small space for solder or braze material between electrical contacts of the sound production unit 336 and the control unit 316 is provided. As discussed previously with respect to FIG. 5, the control unit 316 houses a variety of components configured for operation of the audio device 300 including one or more of a battery, on-board memory, a processor or logic chip, a wireless communications unit, a microphone, and an amplifier, among others.

Due to the placement of the audio device 300 within the ear canal 2, the audio device 300 may include a bone-conduction microphone and may incorporate one or more sensors configured to detect biological data and/or movement data associated with the user. For example, the sensors may detect a user's body temperature, perspiration, blood pressure, and pulse among other biological data. Sensors such as accelerometers may be provided to detect a number of steps taken by the user and the intensity of the user's movements among other data useable to determine the user's level of activity, caloric expenditures, or the like.

The control unit 316 may be provided with software configured to collect biological data and/or movement data, process the data, and perform calculations based on the data the results of which can be provided to the user audibly or communicated to an associated mobile device, such as a smartphone or the like. Alternatively, tasks associated with collecting and/or processing the data can be offloaded to the mobile device.

In one embodiment, the sound-production unit 336 comprises a speaker with a diaphragm or cone surrounded by a rigid frame 383. The frame 383 may be formed by the body 310 or may be coupled to the body 310. The frame 383 provides an annular ring that surrounds the speaker cone and provides a mounting location for the ear tip 350.

The ear tip 350 comprises a section of material similar to that described previously with respect to the ear tip 150, e.g. silicon. In one embodiment, the ear tip 350 extends around the annular ring of the frame 383 to form a generally torus-shaped member surrounding the annular ring. Although the ear tip 350 is described as having a torus shape, it is understood that other forms may be employed without departing from the scope of exemplary embodiments described herein, e.g. forms in which a non-circular polygonal or curvilinear shape is revolved about an axis. Forms of the ear tip 350 may also comprise non-uniform forms that vary in shape and/or size around the frame 383. Such non-uniform ear tips 350 might provide a tailored fit for individual users and/or users with non-uniformly shaped ear canals 2.

The outer diametrical dimension of the ear tip 350 is generally larger than that of the body 310 and is sized to fit within the ear canal 2 of the user while also forming a seal between the ear tip 350 and the wall of the ear canal 2. The ear tip 350 may at least partially deform to conform to the shape of the user's ear canal 2. The fit with the ear canal 2 is sufficient to provide friction to retain the audio device 300 within the ear canal 2 but not cause discomfort or irritation thereof. In one embodiment, the ear tip 350 is removable and/or replaceable on the annular ring to allow ear tips 350 of different sizes/dimensions to be interchanged, thereby allowing a user to obtain a desired fit. In another embodiment, the ear tip 350 is molded onto the frame 383; sizing of the ear tip 350 with respect to the user's ear canal 2 is thus achieved by selecting an audio device 300 having an ear tip 350 molded thereon with appropriate dimensions. In another embodiment, dimensions of the ear tip 350 are adjustable to provide a desired fit.

The ear tip 350 and the seal provided between the ear tip 350 and the interior of the ear canal 2 may provide at least partial noise isolation, e.g. prevent a majority of environmental sounds from traveling through the ear canal 2 and being heard by the user. In one embodiment, the ear tip 350 prevents substantially all environmental noise from being heard by the user the ear canal 2; it is understood that some environmental noise may be heard by the user through the body, e.g. skin and bones, and not via travel through the ear canal 2.

The audio device 300 may also be configured to provide active noise cancellation and/or pass-through of at least a portion of environmental noise by means known in the art. As described herein, noise cancellation includes production of sound waves of opposite phase to those received from the environment (also referred to as destructive interference) in order to cancel out the environmental sound waves and effectively reduce the volume of the environmental sound waves that is perceivable by the user. Pass-through or audio transparency is understood as reproduction of sounds received from the environment by the audio device 300 such that the user can hear the reproduced sounds. The environmental sounds may be filtered or otherwise processed before being reproduced via the sound-production unit 336. The level of noise cancellation and/or pass-through may be selectively adjustable by the user.

Figure 28:
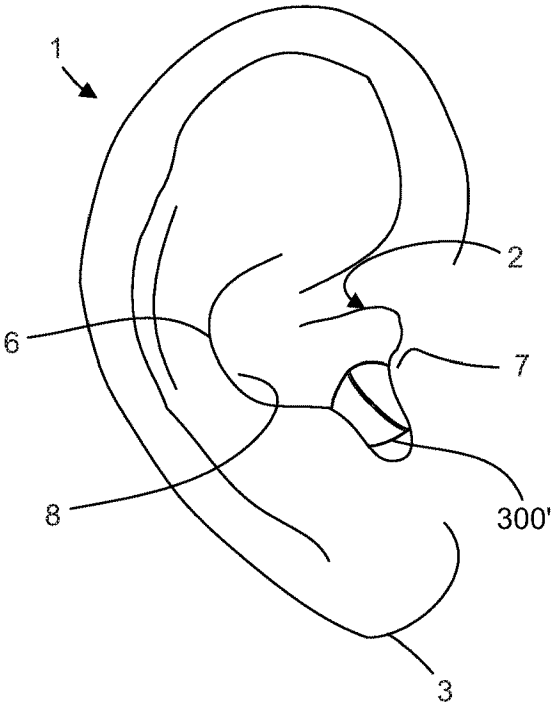
FIG. 28 depicts the audio device of FIG. 27 disposed within contours of the pinna of an ear in accordance with an exemplary embodiment.
Figure 27:
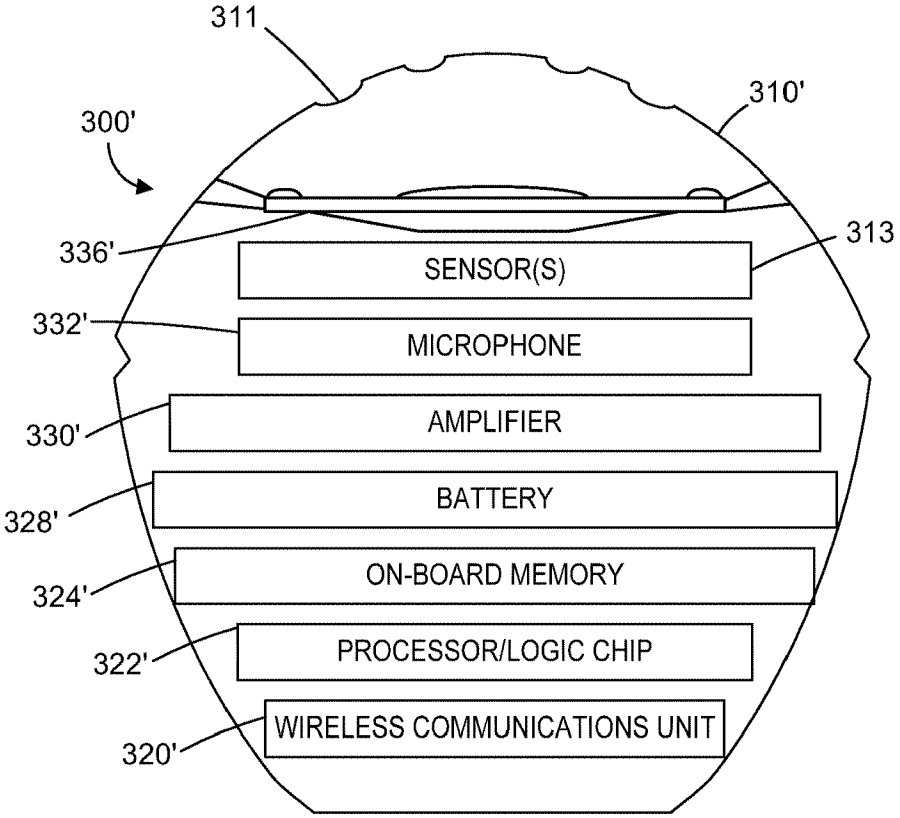
FIG. 27 is a block diagram depicting components of an integrated audio device depicted in accordance with an exemplary embodiment.

FIGS. 27-28 depict another exemplary embodiment of an integrated audio device 300'. The audio device 300' is configured in much the same manner as the audio device 300 with the control unit 316' and the sound-production unit 336' integrated into a single body 310', but without the ear tip 350. The body 310' is also configured to rest and be retained within the contours of the user's ear without substantial insertion into the ear canal 2. For example, the audio device 300' may rest in the space defined by the tragus 7, the concha 8, and the antitragus 9 as shown in FIG. 28. As depicted in FIGS. 27-28 the body 310' is substantially spherical in shape but other forms may be employed. Configuration of the audio device 300' in this manner eliminates the need for an ear tip. FIG. 27 depicts a schematic cross-sectional view of the audio device 300' showing a sound-production unit 336' such as a speaker or similar device disposed within the body 310' and directed to provide an audible output through apertures 311' in the body 310'. The audio device 310' is also shown to include a wireless communications unit 320', on-board memory 324', a battery 328', an amplifier 330', and a microphone 332', but may include other components instead of or in addition to these components such as sensors 313, antennas, user interfaces, or the like.

The sensors 313 can comprise one or more of a variety of sensors including location, position, and/or orientation sensors that detect location, movement, and/or orientation of the audio device 300'. The sensors 313 might also comprise sensors for detecting environmental conditions such as temperature, humidity, air quality, air constituents, or the like as well as sensors for detecting light and sound, e.g. cameras and microphones, among others.

Returning to FIGS. 19-20, the cover 352 forms a cavity of sufficient dimensions to receive the audio device 300 therein. The cavity may be dimensioned to form a close-fitting relationship with the audio device 300 to provide a friction-fit or mechanical engagement with the audio device 300 to removeably retain the audio device 300 therein. The cover 352 might include a lid or cap to retain the audio device 300 within the cavity.

The cover 352 can be configured to provide charging of a battery in the audio device 300 when installed therein. Charging of the battery is preferably conducted via an inductive charging means, but may alternatively be performed via engagement of electrical contacts provided on the exterior of the body 310 and the interior surface of the cover 352. The cover 352 may include a battery or be coupled to a mobile device or power grid that provides a source of electrical power for the charging operation.

The cover 352 can be a standalone component that can be coupled to a personal article that is wearable by a user, or the cover 352 can be integrated into a wearable personal article. Wearable personal articles include, for example, but not limitation, jewelry, eyeglasses, watches, belt buckles, belts, bracelets, hats, headbands, shirts, pants, shoes, or other personal items that can be worn by a user on his or her body. For example, in one embodiment depicted in FIGS. 19-20, the cover 352 comprises a gauge-style piercing. The cover 352 comprises a ring with a bore extending axially therethrough in which the audio device 300 can be disposed in friction-fitting manner. The cover 352 may be worn or installed in a piercing in the lobe 3 of a user's ear.

Figures 21, 22:
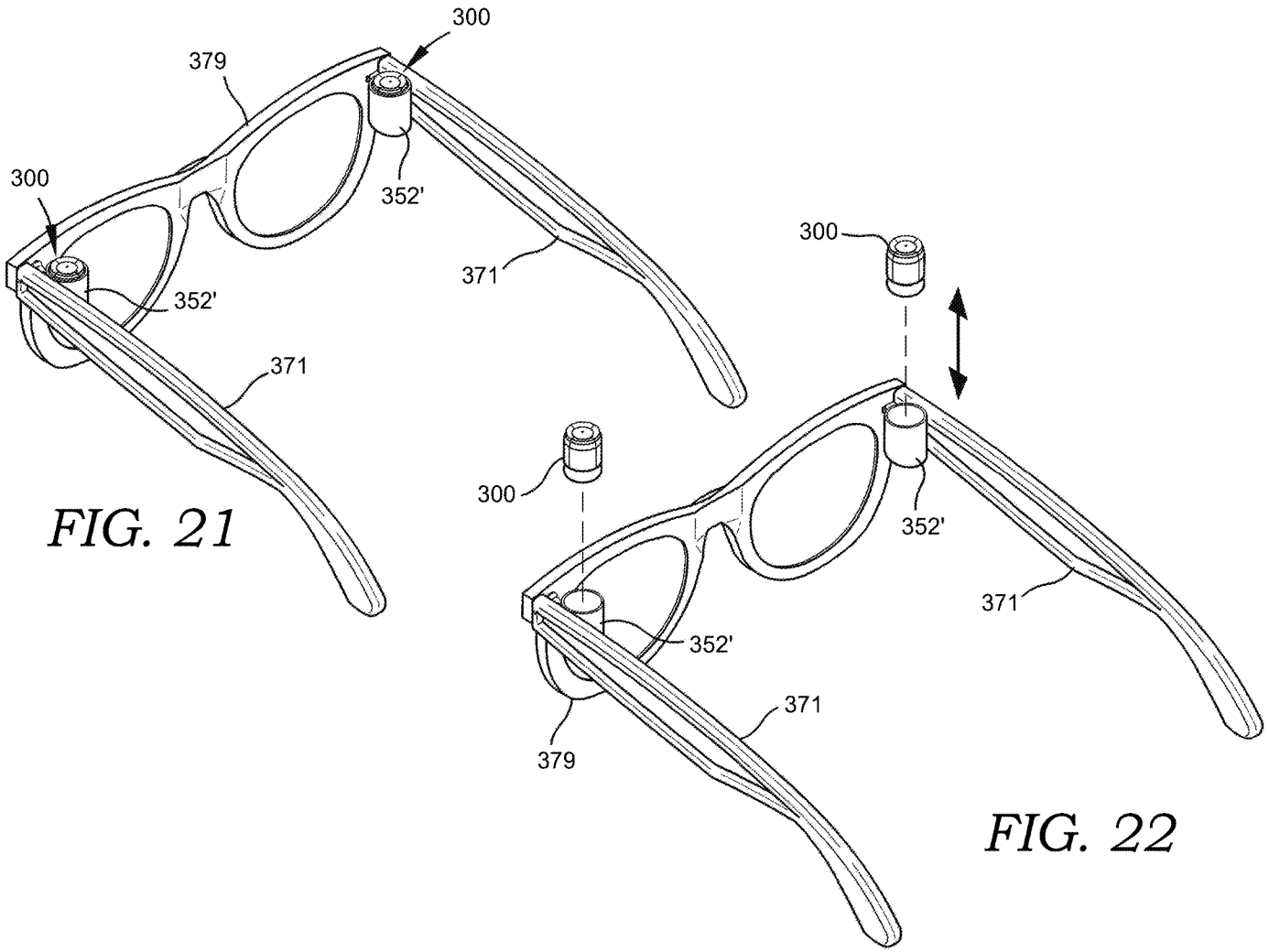
FIGS. 21 and 22 are perspective views of the audio device of FIG. 17 depicted within and removed from a cover that is integrated into the temple pieces of a pair of glasses in accordance with an exemplary embodiment.

In another embodiment depicted in FIGS. 21-22, a cover 352' comprises a cylindrical form with a blind bore extending into one end thereof. The cover 352' is formed integrally with temple pieces 371 of a pair of eyeglasses 379. The cover 352' might alternatively be formed to include a clip or a pair of arms extending from the outer surface thereof that are configured to grasp the temple 371 of the pair of eyeglasses 379 or any of a variety of other wearable personal articles. The audio device 300 can be disposed in the cover 352' for storage in a non-use orientation or removed therefrom and installed in the ear canal 2 of the user in a use orientation.

Figure 24:
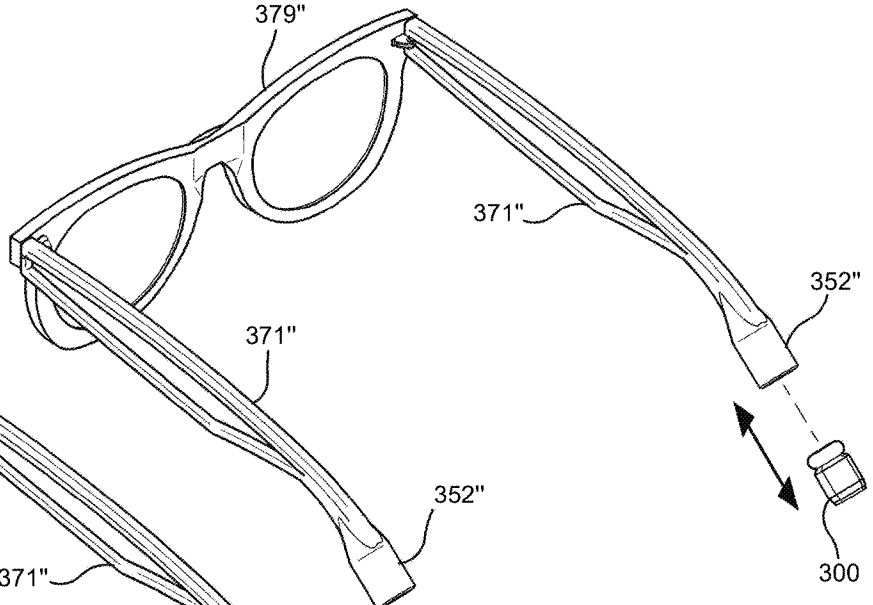
FIGS. 23 and 24 are perspective views of the audio device of FIG. 17 depicted within and removed from a cover that is integrated into distal ends of the temple pieces of a pair of eyeglasses in accordance with an exemplary embodiment.
Figure 23:
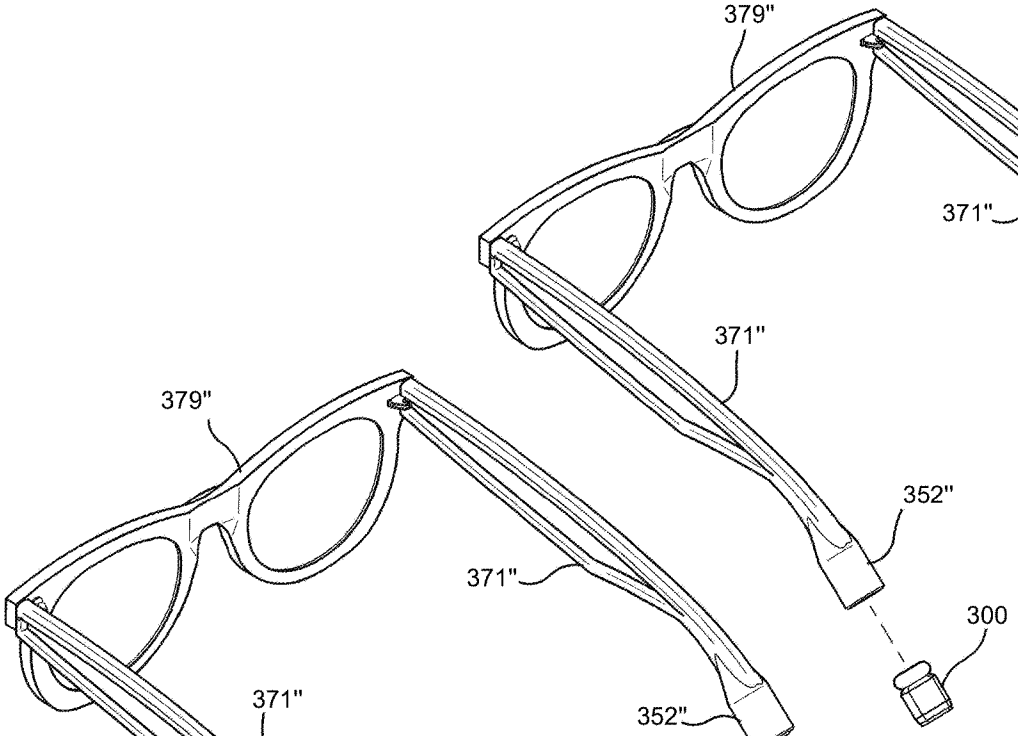
Figure 26:
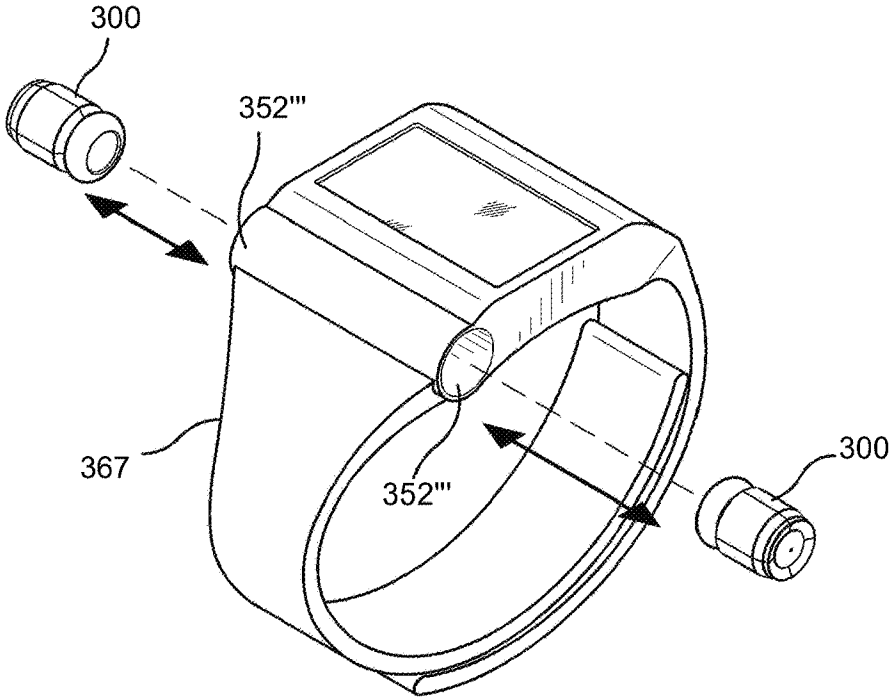
FIGS. 25 and 26 are perspective views of the audio devices of FIG. 17 depicted within and removed from a cover that is integrated into a wristband in accordance with an exemplary embodiment.
Figure 25:
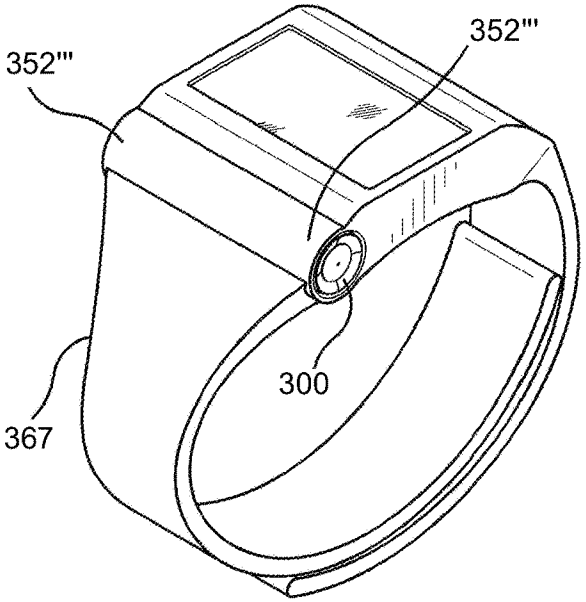

Referring now to FIGS. 23-24, in another embodiment, a cover 352" is integrated into the end of the temple or at the temple tip, e.g. the blind bore is formed to extend into the temple tip. In other exemplary embodiments, a cover 352''' is integrated into a watchband 367 as depicted in FIGS. 25-26 or might be integrated into a headband, a hat, or another personal article.

Many different arrangements of the various components depicted, as well as components not shown, are possible without departing from the scope of the claims below. Embodiments of the technology have been described with the intent to be illustrative rather than restrictive. Alternative embodiments will become apparent to readers of this disclosure after and because of reading it. Alternative means of implementing the aforementioned can be completed without departing from the scope of the claims below. Identification of structures as being configured to perform a particular function in this disclosure and in the claims below is intended to be inclusive of structures and arrangements or designs thereof that are within the scope of this disclosure and readily identifiable by one of skill in the art and that can perform the particular function in a similar way. Certain features and sub-combinations are of utility and may be employed without reference to other features and sub-combinations and are contemplated within the scope of the claims.

What is claimed is:

1. A wearable audio device comprising:

a housing with a speaker disposed at least partially therein, the housing including an output portion through which an audible output produced by the speaker is directed, and the housing having an elongate configuration with a longitudinal dimension and a transverse dimension that is smaller than the longitudinal dimension, the housing being adapted for insertion and retention at least partially within an ear canal of a user's ear;

an eartip coupled to the output portion of the housing, the eartip having a transverse dimension that is larger than the transverse dimension of the housing;

a cover including a body with a hollow interior space configured to receive at least a portion of the housing therein; and a wearable personal article adapted to be worn on the ear of the user, the cover being integrated into the wearable personal article.

2. The wearable audio device of claim 1, wherein the elongate configuration of the housing is at least partially cylindrical.

3. The wearable audio device of claim 2, wherein one end of the cylindrical elongate configuration is tapered.

4. The wearable audio device of claim 1, wherein the eartip forms a seal between the housing and an inner surface of the user's ear canal.

5. The wearable audio device of claim 1, wherein the ear tip is substantially torus-shaped.

6. The wearable audio device of claim 1, wherein the housing includes a gripping feature proximate an end of the housing, the end being opposite the output portion, the gripping feature aiding removal of the audio device from the user's ear canal.

7. The wearable audio device of claim 6, wherein the gripping feature comprises one or more of an annular groove and an annular ridge extending at least partially about a circumference of the housing and configured for engagement by a user's fingernail.

8. The wearable audio device of claim 1, wherein, the housing and the cover are moveable relative to one another between a non-use orientation in which the cover substantially encloses the ear tip and a use orientation in which the ear tip is unobstructed by the cover and is disposable into the ear canal of the user to direct sound produced by the speaker into the ear canal of the user.

9. The wearable audio device of claim 8, wherein in the non-use orientation the audio device is disposed in the cover, the cover is suspended from a piercing in the user's ear, and the cover at least partially encloses and disguises the housing to resemble a piece of jewelry.

10. The wearable audio device of claim 8, wherein the cover is inserted into a piercing in the user's ear, and in the non-use orientation the audio device is inserted into the cover, and the cover at least partially encloses and disguises the housing to resemble a piece of jewelry.

11. A wearable audio device comprising:

a housing with a speaker disposed at least partially therein, the housing including an output portion through which an audible output produced by the speaker is directed, and the housing having an elongate configuration with a longitudinal dimension and a transverse dimension that is smaller than the longitudinal dimension, the housing being adapted for insertion and retention at least partially within an ear canal of a user's ear;

an eartip coupled to the output portion of the housing, the eartip having a transverse dimension that is larger than the transverse dimension of the housing;

a cover including a body with a hollow interior space configured to receive at least a portion of the housing therein;

a wearable personal article adapted to be worn on the arm of the user, the cover being integrated into the wearable personal article.

12. A wearable audio device comprising:

a housing with a speaker disposed at least partially therein, the housing including an output portion through which an audible output produced by the speaker is directed, and the housing having an elongate configuration with a longitudinal dimension and a transverse dimension that is smaller than the longitudinal dimension, the housing being adapted for insertion and retention at least partially within an ear canal of a user's ear;

an eartip coupled to the output portion of the housing, the eartip having a transverse dimension that is larger than the transverse dimension of the housing;

a cover including a body with a hollow interior space configured to receive at least a portion of the housing therein;

a wearable personal article adapted to be worn on the head of the user, the cover being integrated into the wearable personal article.

13. A wearable audio device comprising:

a housing with a speaker disposed at least partially therein, the housing including an output portion through which an audible output produced by the speaker is directed, and the housing having an elongate configuration with a longitudinal dimension and a transverse dimension that is smaller than the longitudinal dimension, the housing being adapted for insertion and retention at least partially within an ear canal of a user's ear;

an eartip coupled to the output portion of the housing, the eartip having a transverse dimension that is larger than the transverse dimension of the housing;

a cover including a body with a hollow interior space configured to receive at least a portion of the housing therein;

a wearable personal article adapted to be worn on the torso of the user, the cover being integrated into the wearable personal article.

14. A wearable audio device comprising:

a wearable personal article adapted to be worn on an ear of a user;

a cover integrated into the wearable personal article, the cover including an interior space;

a housing disposed at least partially within the interior space of the cover in a non-use orientation, the housing being removable from the cover and being sized for at least partial insertion into an ear canal of a user in a use orientation;

a control unit disposed in the housing and configured to receive wireless communications associated with an audio output;

a speaker disposed at least partially within the housing;

an ear tip coupled about a circumference of an end of the housing and extending at least partially radially outward from the housing, the ear tip adapted for insertion into the ear canal of the user and to frictionally retain the housing at least partially within the ear canal of the user in the use orientation.

15. A wearable audio device comprising:

a wearable personal article adapted to be worn on a user's arm;

a cover integrated into the wearable personal article, the cover including an interior space;

a housing disposed at least partially within the interior space of the cover in a non-use orientation, the housing being removable from the cover and being sized for at least partial insertion into an ear canal of a user in a use orientation;

a control unit disposed in the housing and configured to receive wireless communications associated with an audio output;

a speaker disposed at least partially within the housing;

an ear tip coupled about a circumference of an end of the housing and extending at least partially radially outward from the housing, the ear tip adapted for insertion into the ear canal of the user and to frictionally retain the housing at least partially within the ear canal of the user in the use orientation.

16. A wearable audio device comprising:

a wearable personal article adapted to be worn on a user's head;

a cover integrated into the wearable personal article, the cover including an interior space;

a housing disposed at least partially within the interior space of the cover in a non-use orientation, the housing being removable from the cover and being sized for at least partial insertion into an ear canal of a user in a use orientation;

a control unit disposed in the housing and configured to receive wireless communications associated with an audio output;

a speaker disposed at least partially within the housing;

an ear tip coupled about a circumference of an end of the housing and extending at least partially radially outward from the housing, the ear tip adapted for insertion into the ear canal of the user and to frictionally retain the housing at least partially within the ear canal of the user in the use orientation.

17. The wearable audio device of claim 16, wherein the wearable personal article comprises one or more of eyeglass frames, a hat, and a headband.

18. A wearable audio device comprising:

a wearable personal article adapted to be worn on a user's torso;

a cover integrated into the wearable personal article, the cover including an interior space;

a housing disposed at least partially within the interior space of the cover in a non-use orientation, the housing being removable from the cover and being sized for at least partial insertion into an ear canal of a user in a use orientation;

a control unit disposed in the housing and configured to receive wireless communications associated with an audio output;

a speaker disposed at least partially within the housing;

an ear tip coupled about a circumference of an end of the housing and extending at least partially radially outward from the housing, the ear tip adapted for insertion into the ear canal of the user and to frictionally retain the housing at least partially within the ear canal of the user in the use orientation.

19. The wearable audio device of claim 18, wherein the wearable personal article comprises one of a shirt, belt buckle, and a belt.

20. The wearable audio device of claim 18, wherein the wearable personal article comprises one of pants and a shoe.

* * * * *